US012807298B2

(12) United States Patent
Medland et al.

(10) Patent No.: US 12,807,298 B2
(45) Date of Patent: Nov. 24, 2026

(54) SYSTEMS AND METHODS FOR GENERATING RENEWABLE ENERGY

(71) Applicant: DRIFT ENERGY LTD., Hertford (GB)

(72) Inventors: Ben Medland, Hertford (GB); Andrew Perry, Hertford (GB); Kate Orchard, Hertford (GB); Laurence Cowton, Hertford (GB); Erick Hinds-Mingo, Hertford (GB)

(73) Assignee: DRIFT ENERGY LTD., Hertford (GB)

( * ) Notice: Subject to any disclaimer, the term of this patent is extended or adjusted under 35 U.S.C. 154(b) by 301 days.

(21) Appl. No.: 18/705,418

(22) PCT Filed: Oct. 27, 2022

(86) PCT No.: PCT/GB2022/052739

§ 371 (c)(1),
(2) Date: Apr. 26, 2024

(87) PCT Pub. No.: WO2023/073376

PCT Pub. Date: May 4, 2023

(65) Prior Publication Data

US 2025/0178712 A1 Jun. 5, 2025

(30) Foreign Application Priority Data

| | | |
|---|---|---|
| Oct. 27, 2021 | (GB) | 2115474 |
| Jul. 8, 2022 | (GB) | 2210072 |
| Oct. 11, 2022 | (GB) | 2214987 |

(51) Int. Cl.
*B63J 3/04* (2006.01)
*B63B 35/00* (2020.01)

(52) U.S. Cl.
CPC ..... *B63J 3/04* (2013.01); *B63B 35/00* (2013.01); *B63B 2035/007* (2013.01); *B63B 2035/009* (2013.01); *B63J 2003/046* (2013.01)

(58) Field of Classification Search
CPC ..... B63J 3/04; B63J 2003/046; B63B 35/00; B63B 2035/007; B63B 2035/009; B63B 79/40; F03D 9/00; B63H 19/02
See application file for complete search history.

(56) References Cited

U.S. PATENT DOCUMENTS 4,335,093 A * 6/1982 Salomon ..... F03D 9/25 244/33
7,789,723 B2 * 9/2010 Dane ..... B63G 8/001 114/39.21

(Continued)

FOREIGN PATENT DOCUMENTS

EP 2498056 A1 9/2012
EP 3644014 A1 4/2020

(Continued)

OTHER PUBLICATIONS

International Search Report and Written Opinion mailed Apr. 25, 2023 in International Application No. PCT/GB2022/052739, 17 pages.

(Continued)

*Primary Examiner* — Tye William Abell
(74) *Attorney, Agent, or Firm* — CALDWELL LLC

(57) ABSTRACT

A movable maritime vessel for generating, storing and transporting energy, the vessel comprising a hull, at least one sail configured to capture wind energy to move the vessel, and an energy generation system comprising a hydro generator, wherein the hydro generator is configured to generate energy from the movement of fluid, for example water, for example sea water, through the hydro generator.

19 Claims, 30 Drawing Sheets

(56) References Cited

U.S. PATENT DOCUMENTS

| | | | | |
|---|---|---|---|---|
| 2002/0090868 | A1* | 7/2002 | Schmitman | H01M 8/186 440/113 |
| 2017/0110883 | A1* | 4/2017 | Tabe | F03B 13/26 |
| 2019/0367387 | A1* | 12/2019 | Gwon | B63J 3/04 |
| 2020/0094933 | A1* | 3/2020 | Ouchi | B63H 9/061 |
| 2021/0156692 | A1* | 5/2021 | Moriwaki | G01C 21/203 |
| 2021/0214058 | A1* | 7/2021 | Hine | B63B 1/121 |

FOREIGN PATENT DOCUMENTS

| | | | |
|---|---|---|---|
| ES | 2326710 | A1 | 10/2009 |
| FR | 2997733 | A1 | 5/2014 |
| GB | 2526681 | A | 12/2015 |
| JP | 2013134089 | A | 7/2013 |
| RU | 2567484 | C1 | 11/2015 |
| WO | 02/16289 | A2 | 2/2002 |
| WO | 2019180323 | A1 | 9/2019 |

OTHER PUBLICATIONS

Pengcheng et al., "Research progress on ship power systems integrated with new energy sources: A review", Apr. 5, 2021, vol. 144, 21 pages.

International Preliminary Report on Patentability issued Apr. 30, 2024 for Application No. PCT/GB2022/052739, 12 pages.

Babarit, et al. "Exploitation of the far-offshore wind energy resource by fleets of energy ships—Part 1: Energy ship design and performance"; https://doi.org/10.5194/wes-5-839-2020; Wind Energ. Sci., 5, 839-853, 2020; Received: Dec. 12, 2019—Discussion started: Feb. 24, 2020 Revised: Apr. 23, 2020—Accepted: Jun. 6, 2020—Published: Jul. 3, 2020.

* cited by examiner

Approximate Specifications

| Dimension | Value |
|---|---|
| Length | 32m |
| Beam | 21m |
| Foil Depth | 4m |
| Ride Height | 3m |
| Mast Height | 35m |
| Sail Area | 654m$^2$ |
| Hydrogenerator Diameter | 0.7m |
| Electrolysis Capacity | ~1MW |
| Liquid Hydrogen Storage | 3000kg |

Approximate Specifications

| Dimension | Value |
|---|---|
| Length | 100m |
| Beam | 42m |
| Foil Depth | 4m |
| Ride Height | 3m |
| Mast Height | 70m |
| Sail Area | 6188m$^2$ |
| Hydrogenerator Diameter | 2.2m |
| Electrolysis Capacity | ~10MW |
| Liquid Hydrogen Storage | 30,000kg |

21000

SYSTEMS AND METHODS FOR GENERATING RENEWABLE ENERGY

CROSS-REFERENCE TO RELATED APPLICATIONS

The present application is a U.S. National Stage patent application of International Patent Application No. PCT/GB2022/052739, filed on Oct. 27, 2022, which claims the benefit of United Kingdom Application No. GB2115474.5 filed on Oct. 27, 2021, United Kingdom Application No. 2210072.1 filed on Jul. 8, 2022, and United Kingdom Application No. 2214987.6 filed on Oct. 11, 2022, the benefit of which is claimed and the disclosures of which are incorporated herein by reference in their entirety.

FIELD OF THE INVENTION

The present invention relates to methods, systems and apparatuses for power generation and energy storage, transport and utilisation. In particular, the invention relates to renewable/clean energy, particularly offshore wind.

BACKGROUND OF THE INVENTION

There are almost 8 billion people on Earth and each year 81 million people are added to the population. The global demographic is also changing with one new person added to the middle class every second. Increasing demand for digital consumer technologies, the electrification of transportation and even crypto-currencies are driving up the energy needs of the population. Latest estimates put the average electrical consumption per person at 3 MWh per year.

Despite huge investment in renewables ($282bn invested in 2019) and 87 governments writing 2030 targets into policy, the world is still producing 33,000,000,000 tons of $CO^2$ a year, with the power sector accounting for nearly two thirds of emissions growth. Currently, renewable energy accounts for ~13.4% of global power generation, with governments committed to adding an additional 826 GW of new (non-hydro) renewable power through 2030 at a cost of $1 trillion.

The UK itself needs to build 32 GW of offshore wind to meet its own targets. This is a huge install of potentially over 7000 cutting edge 10 MW class wind turbines. However, existing ways of harnessing offshore wind have drawbacks. They require lots of space (~300 acres per turbine, which is about the size of Hyde Park). Indeed, in the US, by 2030, it is estimated that solar and wind farms will cover 62,000 square miles, roughly the equivalent of the state of Illinois. Furthermore, this space needs to be near to coastlines to reduce transmission losses. They are prone to weather patterns, capital intensive to build, install and maintain and have long installation times. In summary, the world needs more energy, needs it to be green and needs it fast.

There is therefore a need for improved renewable energy generation and usage, including an improvement on conventional offshore wind.

As with all systems of energy generation, one of the primary metrics for assessing the efficacy of a given system is its efficiency. In the case of systems of renewable energy generation, the efficiency of such systems can heavily depend on fluctuating weather conditions, which is particularly the case for offshore wind and hydro generation systems.

Accordingly, there is therefore also a need for improved methods and systems for optimising renewable energy generation, including improvements to methods and systems for routing movable maritime vessels capable of generating, storing, and transporting energy.

SUMMARY OF THE INVENTION

In accordance with the present invention, there is provided a movable maritime vessel for generating, storing and transporting energy, the vessel comprising:

- a hull;
- at least one sail configured to capture wind energy to move the vessel; and
- an energy generation system comprising a hydro generator, wherein the hydro generator is configured to generate energy from the movement of fluid, for example sea water, through the hydro generator.

In this way, unlike conventional offshore (i.e. land-based) wind technologies, wind is used to move and manoeuvre a vessel (e.g. boat, ship, catamaran, etc.) and a hydro generator on the vessel is used to capture the combined energy of the wind and surrounding water e.g. seas and oceans.

This allows for flexibility of location, thereby increasing the utilisation ("load factor") of the system and minimisation of occupied area. The hydro generator may comprise a turbine. The sail may be reefable. The sail may be automatically controlled e.g. by means of a computer program or artificial intelligence.

The vessel may further comprise an energy transformation system configured to receive and process energy generated by the energy generation system. This means that the energy generated by the energy generation system can be transformed (i.e. processed/developed) on the vessel and on the move whilst maintaining the advantages of flexibility of location and minimisation of occupied area.

The vessel may further comprise an energy storage system configured to store energy received from the energy generation system and/or the energy transformation system. This means that the energy generated by the energy generation system and/or transformed (i.e. processed/developed) by the energy transformation system can be stored and transported on the vessel and on the move whilst maintaining the advantages of flexibility of location and minimisation of occupied area.

The energy transformation system may comprise:

i) a water purification plant for purifying liquid, for example sea water, wherein the water purification plant comprises at least one of a filter and a desalination unit, the water purification plant being configured to output purified liquid via a first conduit; and ii) an electrolysis plant for electrolysing liquid received from the water purification plant via the first conduit, and for outputting gas e.g. oxygen gas to atmosphere via a second conduit, and for outputting gas e.g. hydrogen gas via a third conduit.

As well as the water purification plant and electrolysis plant described above, the energy transformation system may further comprise a liquefaction plant for liquefying gas e.g. hydrogen gas received from the electrolysis plant via the third conduit and outputting liquid e.g. liquid hydrogen via a fourth conduit.

This arrangement in combination with the energy storage system described herein makes multiple uses of water, particularly sea water, along with wind power, thereby resulting in a unique and efficient system. The same water e.g. sea water that is used to drive the energy generation system (particularly the turbine) is also used for electrolysis in producing hydrogen gas that can be stored on the vessel and then offloaded when the vessel reaches land e.g. a port.

One of, any number of, or all of the water purification plant, electrolysis plant and liquefaction plant may be partially or entirely powered by energy from the energy generation system. This allows for maximum efficiency of use of the energy generated by the energy generation system on the move whilst maintaining the advantages of flexibility of location and minimisation of occupied area.

The energy storage system may comprise a storage tank, for example a cryogenic storage tank, for storing liquid, for example liquid hydrogen, received from the liquefaction plant via the fourth conduit. Storing energy using liquid hydrogen allows for a higher density of hydrogen payload. In other words, you can store more energy on board for a given volume of hull. Cryogenic energy storage is also simpler than compressed gas energy storage. It allows for a lighter tank and is less costly than, for example, a compressed gas tank. Alternatively or additionally, the energy storage system may comprise a compressor configured to receive gas, for example hydrogen gas, from the electrolysis plant via the third conduit and a gas storage tank for storing the gas.

The energy storage system may further comprise a fuel cell, for example a hydrogen fuel cell, wherein the storage tank may be configured to output hydrogen gas boil off via a fifth conduit and wherein the fuel cell may be configured to receive hydrogen gas boil off from the storage tank via the fifth conduit. The use of a fuel cell e.g. hydrogen fuel cell along with the storage tank allows for additional and different energy storage on the move whilst maintaining the advantages of flexibility of location and minimisation of occupied area.

The hydro generator may be:

i) directly attached to the hull; or ii) attached to the hull by a flexible or inflexible connector, for example so that the vessel tugs the hydro generator.

The hydro generator may be connected to the hull by means of a flexible or inflexible connector or appendage that is configured to lift clear of the liquid e.g. sea water should there be excessive drag. Alternatively or additionally, the vessel may comprise a sea kite attached to the hull by a flexible connector. The hydro generator may be configured to partially or wholy power the vessel. The hydro generator may be attached to the hull by a keel. The hydro generator may take a ducted nacelle form.

The energy generation system may further comprise at least one solar panel or an array of solar panels. This adds another means of generating energy on the vessel, and the fact that the vessel is able to move to any desired location means that the chosen location of the vessel can be selected (manually or automatically e.g. using artificial intelligence) to maximise the combined potential of energy generation using the hydro generator and energy generation using the at least one solar panel or array of solar panels.

The at least one solar panel or array of solar panels may be located on at least one upward facing surface of the hull and/or embedded in the at least one sail. These have been found to be optimum locations for the at least one solar panel and/or array of solar panels.

The energy storage system may comprise a battery or an array of batteries (e.g. LiPo) configured to store energy from any part of the energy generation system and/or the energy transformation system. This maximises the energy storage potential of the vessel on the move whilst maintaining the advantages of flexibility of location and minimisation of occupied area.

The vessel may further comprise circuitry configured to communicate with a remote control system in order to navigate the vessel, for example autonomously and/or with the use of artificial intelligence. This allows for the benefits of the vessel described herein to be optimised based on information and machine learning on location, weather conditions, tides, convenience, etc.

The circuitry may be partially or entirely powered by energy from the energy generation system. This further increases the use and efficiency of the energy generated by the energy generation system.

There is also provided a method comprising the steps of:

generating energy on a movable maritime vessel via an energy generation system;

transforming the energy generated by the energy generation system on the vessel via an energy transformation system;

storing the energy received from the energy generation system and/or the energy transformation system on the vessel by means of an energy storage system; and transporting the energy stored in the energy storage system to an endpoint on land.

In this way, the benefits of the vessel described above can be further enhanced because the same vessel that provides these advantages can transport stored energy (e.g. in the form of liquid hydrogen) to an appropriate location e.g. on land.

The vessel may be a vessel according to any embodiment or example defined herein.

In accordance with the present invention, there is provided a computer-implemented method for routing a movable maritime vessel to optimise energy generation along a journey, the movable maritime vessel capable of generating, storing and transporting energy, comprising:

a) receiving one or more inputs associated with the journey;

b) based on the received inputs, determining a set of possible routes for the vessel to be optimised over N timesteps of the journey, where N is a predetermined number;

c) from the set of possible routes, identifying an optimal route to be taken by the vessel over a next timestep of the journey;

d) navigating the vessel over the next timestep of the journey according to the identified optimal route; and e) after navigating the vessel over the next timestep of the journey, determining whether the vessel has completed the journey.

The method allows for harnessing journey data to optimise the energy generation capacity of a vessel, i.e., the utilisation of the vessel's energy generation system.

By routing the vessel based on one or more inputs associated with the journey, i.e., journey data, for example, journey properties, vessel properties, environmental data and weather data, it is possible to optimise the course of the vessel along a journey to maximise energy generation of the vessel along the journey. For example, the vessel may harness wind, wave and solar energy in the deep ocean, convert it to hydrogen and/or other forms, store the hydrogen and/or other energy forms in its hull for transporting to ports or hubs for energy discharge. The method may therefore route the vessel along a journey to keep the vessel in optimum weather and/or environmental conditions, for example, weather conditions relating to wind, wave and solar. By keeping the vessel in optimum weather and/or environmental conditions, one or more routes may be developed for the vessel over the course of the journey of the vessel that maximises the average utilisation, i.e., load factor, of an energy generation system of the vessel along the journey. For example, a target average utilisation may be over 80%. The journey of the vessel may be from a starting location to an ending location, for example, one or more ports, across the ocean, for example, the deep ocean.

The method may be used to route vessels according to embodiments and examples disclosed herein or other suitable vessels.

Step b) of the method may comprise:

b1) based on the received inputs, determining a set of possible routes for the vessel over a next timestep;

b2) assigning each of the possible routes for the vessel over the next timestep a net score, wherein the net score is a reward score for the respective route less a penalty score for the respective route;

b3) filtering out possible routes for the vessel over the next timestep having a net score below a predetermined threshold; and b4) incrementing the timestep and repeating steps b1) through b3) N−1 times for each of the routes not filtered out to determine a set of possible routes for the vessel to be optimised over N timesteps of the journey.

Step b) of the method may comprise:

b1) based on the received inputs, determining a set of possible routes for the vessel over a next timestep;

b2) for each of the possible routes for the vessel over the next timestep, calculating an expected position of the vessel at the end of the timestep, a reward score for the respective route and a penalty score for the respective route;

b3) assigning each of the possible routes for the vessel over the next timestep a net score based on the reward score for the respective route and the penalty score for the respective route:

b4) selecting one or more of the possible routes for the vessel over the next timestep based on their respective net scores; and b5) incrementing the timestep, and repeating steps b1) through b4) N−1 times for each of the one or more selected possible routes for the vessel over the next timestep to determine a set of possible routes for the vessel to be optimised over N timesteps, wherein each of the set of possible routes for the vessel to be optimised over N timesteps is assigned an aggregate net score based on the sum of the net scores of each of its respective timestep routes.

A given journey that may be taken by a suitable vessel may span many hours across the deep ocean in frequently changing weather and/or environmental conditions, for example, with changing wind speeds and wind directions, as well as with emerging obstacles. In such conditions, it can be costly on energy generation and vessel speed to change the vessel direction, i.e., vessel sailing angle, too frequently. It is therefore more efficient, in terms of energy generation of the vessel, to route the vessel in a given direction for a given timestep before updating the routing of the vessel than when compared to frequently, i.e., continually, changing the direction of the vessel to align the vessel with the direction of the highest wind speeds. At the same time, the timesteps may be narrow enough to avoid the vessel routing into unforeseen obstacles and/or avoiding locations of concern, for example, locations with high piracy rates and/or natural obstacles, for example, icebergs or shallow waters. The method may therefore optimise the route of the vessel over a given horizon, i.e., a number of timesteps, for example a series of intervals, for example 3-hour intervals, updating the route at every timestep. The method may route the vessel over the given horizon, aiming to maximise the amount of energy generated by the vessel for each timestep, while also ensuring that the vessel does not route to locations that have dangerous weather conditions or that are otherwise problematic or are of no interest. The length and amount of timesteps for which the route may be optimised over may be predetermined and fixed prior to a journey of the vessel or may be dynamically varied depending on the progress of the journey and/or other journey properties.

In order to identify the best route of the vessel over a next timestep in the context of a journey spanning multiple timesteps to one of a number of predetermined end locations, all possible routes for the vessel over a horizon of a predetermined number of timesteps must be explored. Having too long a horizon over which to optimise the routing of the vessel may be detrimental to the optimisation of the routing since the future weather and/or environmental conditions affecting the journey of the vessel may differ substantially to that which may be initially forecasted. The best routes for a horizon of given timesteps, i.e., those which have the highest average expected utilisations over the horizon, are determined based on evaluating the rewards and penalties of routes to be taken over individual timesteps, and at each timestep filtering out those routes for which the energy generation benefits are poor. By determining a route over a given horizon on the basis of building up a set of possible routes by considering individual consecutive timesteps, it is possible to increase the chances of avoiding areas of travel which are poor for energy generation, thereby improving the efficiency and rate at which energy is generated by the vessel.

The one or more inputs received may comprise real-time and/or forecasted wind speed and wind direction data and step b1) may comprise:

b1.1) based on the wind direction data, determining a set of possible sailing angles of the vessel;

b1.2) based on the wind speed data, calculating possible vessel speeds for each route of the set of possible routes for the vessel over the next timestep, wherein each route for the vessel over the next timestep corresponds to one of the set of possible sailing angles of the vessel;

b1.3) based on the vessel speeds, estimating a vessel location for each route of the set of possible routes for the vessel at the end of the next timestep;

b1.4) based on the received inputs, filtering out those routes which result in the vessel location at the end of the next timestep being outside a region of interest, for example, where the wind speed at the location of the vessel at the end of the next timestep exceeds a maximum tolerable wind speed that the vessel can sail into.

By determining the set of possible routes for the vessel over the next timestep using wind data, it is possible to optimise the routing of the vessel, which may harness wind and wave energy, according to real-time and forecasted wind conditions. This enables the vessel to achieve optimal utilisation of its energy generation capabilities/systems. By discretising a routing of the vessel on the basis of a discrete set of possible sailing angles of the vessel, the method may be performed more efficiently than when compared to having a continuous range of sailing angles from which to choose from. By considering the location of the vessel at the end of each possible route, it is possible to filter out locations which result in problems downstream, for example, in respect of safety, efficiency, distance from a journey end location, and so on. The number of discrete sailing angles may be predetermined, for example, 10, and may be evenly spaced about 360 degrees to the wind direction. Alternatively, the sailing angles may be evenly spaced between a lower limit and an upper limit, for example, 50 degrees and 310 degrees to the wind direction, respectively.

Step b) of the method may comprise assigning an aggregate net score to each route of the set of possible routes, wherein the aggregate net score for each route is a sum of reward scores for each timestep of the respective route less a sum of penalty scores for each timestep of the respective route.

By assigning an aggregate net score to each route of the set of possible routes it is possible to have an objective basis for comparing routes and selecting one to be chosen for navigating the vessel. Reward scores, i.e., utilisation scores, may be assigned to each route for a given timestep to reflect their estimated energy generation benefits, while penalty scores may be assigned to each route for a given timestep to reflect their estimated deficiencies with respect to the journey of the vessel, for example, how far the vessel is deviating from the general direction of a predetermined journey end location, how dangerous the location is, and so on.

Step b) of the method may comprise estimating a best-case aggregate net score and a worst-case aggregate net score for each route of the set of possible routes for the vessel to be optimised over N timesteps of the journey, wherein the aggregate net score for each route is a sum of reward scores for each timestep of the respective route less a sum of penalty scores for each timestep of the respective route, and filtering out those routes for which the best-case aggregate net score is worse than the route with the highest worst-case aggregate net score.

Estimating the best-case aggregate net score and the worst-case aggregate net score for each route of the set of possible routes for the vessel to be optimised over N timesteps of the journey may be based on a branch and bound algorithm.

Step b) of the method may result in a number of possible routes over a given horizon, i.e., over N timesteps, being determined, each of which will have rewards, i.e., utilisations, estimated with a degree of error. In order to filter the set of possible routes further to enable a more informed selection of an optimal route over a next timestep, best-case scenarios and worst-case scenarios (in terms of energy generation rewards, i.e., utilisations) for each of the set of possible routes may be estimated, and those routes that for which the best-case scenario is worse than the route with the highest worst-case scenario may be filtered out, thus narrowing down the set of routes from which to identify an optimal route over a next timestep.

The calculations of the penalty score for each timestep of a respective route and the reward score for each timestep of a respective route comprise a determination based on the one or more received inputs, for example, environmental data, for example, data relating to oceanic routes.

By calculating a reward score and penalty score for each timestep of a respective route on the basis of the one or more received inputs, for example, environmental data, it is possible to optimise the course of the vessel in terms of energy generation, i.e., utilisation, while taking account the various dangers of routing solely on that basis. For example, a given location or route may be considered dangerous due to having high piracy rates and therefore may be avoided by applying a heavy penalty to routes including such locations/routes. Another example is that particular ports, which may be possible end locations of the journey, may have heavy demands for a particular stored energy form and therefore may present a lucrative end location of the journey of the vessel. Accordingly, routes towards those ports which are not particularly lucrative and/or may be dangerous may have a net score discounted by way of a high penalty score. The impact of turning the vessel, i.e., changing the direction of the vessel, between timesteps on energy generation and vessel speed may also be considered when assigning a penalty score. For example, turning the vessel every 3 hours is likely to have a lower penalty than turning the vessel every 1 hour (should the length of the timestep be reduced). The impact of other vessel properties, for example the reduction of sails or the use of motors of the vessel on energy generation and vessel speed may also be considered when assigning a penalty score. Locations with very high wind speeds may be dangerous to travel through and may be considered when assigning a penalty score or when filtering out routes. Alternatively, high winds can be advantageous for energy generation if not combined with high waves. The penalty score assigned to a route may be a reflection of the route's risk.

The vessel may comprise an energy storage medium, and the calculation of the penalty score for each timestep of a respective route may comprise a determination based on how far the vessel will be from a predetermined end location of the journey at the end of the timestep, and the strength of the penalty score may increase as an amount of energy stored by energy storage medium of the vessel increases.

By calculating a penalty score for each timestep of a respective route on the basis of how the vessel would be from a predetermined end location of the journey at the end of the timestep, it is possible to ensure that the vessel remains close to and/or moving in the direction of a predetermined journey end location, for example, a port for discharging stored energy, while routing. This consideration, of remaining close to and/or moving in the direction of a predetermined journey end location, becomes increasingly more important and the journey of the vessel progresses and the amount of energy stored by the vessel increases.

The vessel may comprise an energy generation system, and the reward score for each timestep of a respective route may comprise a determination based on a sigmoid curve that relates vessel speed to a utilisation of an energy generation system of the vessel.

To ensure that the method is computationally efficient, assigning reward scores for each timestep of a respective route may be done by means of a simple look-up-table, which relates vessel speed to the utilisation of the vessel for the route, i.e., the reward of the route.

The reward score for each timestep of a respective route may be scaled inversely proportional to an amount of time in the future the timestep is.

A determination of a reward for a timestep of a respective route may be based on forecasted weather and/or other data associated with the journey of the vessel. At a given moment, for a forecast of data, the further into the future you look, the more uncertainty there will be with the data. Accordingly, the method may give less weight to determinations based on forecasts further into the future. This ensures that there is less risk with the routing, in terms of possible energy generation losses, and that a healthy average utilisation of the vessel is maintained across the journey.

Step c) may comprise selecting a route from the set of possible routes for the vessel to be optimised over N timesteps that has the highest aggregate net score.

To ensure that the method is computationally efficient, the method may employ a simple and objective policy for identifying an optimal route to be taken by the vessel over a next timestep of the journey. Alternatively, the policy for identifying an optimal route may also involve subjective considerations from a user of the vessel.

The vessel may comprise an energy storage medium/material.

The vessel may store generated energy in the form of liquid hydrogen, and therefore may include a tank as an energy storage medium. Other energy storage mediums and/or forms may also be conceived, for example, electrical storage, for example, batteries. The energy storage medium may be a thermal store.

The vessel may comprise an energy generation system, for example, a hydro generator.

The energy generation system may include a hydro generator on the vessel that is used to capture the combined energy of the wind and surrounding water e.g., seas and oceans. This allows for flexibility of location of the vessel, thereby increasing the utilisation ("load factor") of the system and minimisation of occupied area. The energy generation system may include other means of energy generation, for example, a wind turbine generator and/or a solar panel system.

The one or more inputs associated with a journey of the vessel may comprise real-time and/or forecasted weather data, for example, wind data.

The energy generation capabilities of the vessel may depend significantly on weather conditions, for example, if the vessel generates energy using one or more renewable energy systems. By using real-time and/or forecasted weather data, a more informed determination and identification of optimal routes to be taken by the vessel, in terms of utilisation, may be had. Using such data, it is possible to determine how the sailing of the vessel may be affected by pursuing particular routes and what the consequent effects on energy generation of the vessel are.

The one or more inputs associated with a journey of the vessel may comprise one or more of journey properties, vessel properties, environmental data and weather data.

The journey properties may comprise one or more of journey starting location, journey ending location and journey starting time.

The vessel properties may comprise one or more of a number of discrete sailing angles, a number of timesteps over which to optimise route determination, N, a maximum tolerable wind speed that the vessel can sail into by the vessel, performance data of the vessel, for example, how well the vessel operates in particular wind and/or wave states, and an amount of energy capable of being stored by the vessel.

The environmental data may comprise one or more of data relating to spot prices of liquid hydrogen at various locations, hazard data for oceanic routes, data relating to oceanic shipping channels, environmental data, for examples, satellite data relating to ice flows, data relating to oceanic piracy activity, data relating to marine life, for example oceanic whale routes, data relating to obstacles in the ocean, for example, icebergs or fallen shipping containers, automatic identification system (AIS) data, for example, data relating to other vessels in the ocean.

The weather data may comprise one or more of real-time and/or forecasted wind speed, real-time and/or forecasted wind direction, and/or real-time and/or forecasted oceanic data, for example, wave data, for one or more regions of interest.

As well as using weather data, for example, wind speeds and wave heights, other inputs, i.e., data, associated with the journey of the vessel may be used to determine optimal routes of the vessel for energy generation. These inputs may include journey properties, for example, logistical data for informing the general direction of the routing. The inputs may also include vessel properties, for example, performance metrics and considerations for assessing how the vessel might deal with routing through certain areas and/or locations. The inputs may also include environmental data, for example, data concerning oceanic routes and/or conditions for assessing the travelability of particular routes. All of the inputs may inform the determination of possible routes to be optimised over N timesteps of the journey. The inputs may also be used for assigning reward and penalty sores to each route over a given timestep. Accordingly, the determination and identification of optimal routes to be taken by the vessel for energy generation may be informed by a plurality of variables which may be used to calculate, score and weight the score for each route over a timestep for a set of possible routes over N timesteps. Oceanic data may include seasonal wind, wave and gust data. Performance data of the vessel may include functions of power and energy generation across a timestep as a function of wind speed and wind angle. Vessel properties may include the downtime to offload or discharge stored energy at various end locations of the journey of the vessel, for example, ports. Vessel properties may include whether the vessel is actively generating energy, i.e., whether an energy generation system of the vessel is active. The energy generation system may be inactive if wind speeds are too low and the system is inefficient at such speeds. For example, by creating drag. The vessel properties may also include vessel speeds foe when the energy generation system of the vessel is inactive, for example, the vessel may travel faster when a turbine of a possible energy generation system of the vessel is inactive. The vessel properties may include a high wind speed cut-off point at which the energy generation capabilities are switched off as the vessel speed is set to effectively zero.

If it is determined that the vessel has not completed the journey, steps a) through e) may be repeated.

The routing of the vessel may be performed iteratively. This ensures that the route is periodically updated in view of time-changing conditions and states of the vessel, journey, weather and environment. By determining routes over a given horizon but then updating the route at intervals smaller than the horizon, it is possible to maximise average utilisation of the vessel by predicting a best general direction and making refinements to the routing as the journey progresses.

Step d) may comprise transmitting instructions to the vessel to perform the identified optimal route over the next timestep.

Once an optimal route to be taken by the vessel over a next timestep of the journey is identified, the route may be performed automatically by the vessel using instructions to be processed by processing capabilities of the vessel. Alternatively, the route may be navigated manually by an operator of the vessel. A combination of automatic navigation and manual navigation may also be used.

Step e) may comprise:

e1) determining whether the vessel is within a predetermined radius, for example, a nautical mile radius, for example, a nautical 30-mile radius, 25-mile radius, 20-mile radius, 15-mile radius, 10-mile radius, 5-mile radius, 4-mile radius, 3-mile radius, 2-mile radius or 1-mile radius, of a predetermined end location of the journey;

e2) determining whether an amount of energy stored by an energy storage medium of the vessel is above a predetermined percentage of an energy storage capacity of the energy storage medium; and e3) if both e1) and e2) are determined positively, determining that the vessel has completed the journey, and if one or both of e1) and e2) are determined negatively, determining that the vessel has not completed the journey.

The method of steps a) through e) may be performed iteratively and e1) through e3) provide a possible looping mechanism. If a vessel is approaching a predetermined end location of the journey but still lacks an amount of energy stored, the journey of the vessel may be extended by continuing to determine optimal routes of the vessel for energy generation, and not returning the vessel to port to end the journey. This ensures that the journey is efficient and generates and stores an amount of energy useful to be discharged at a port. At the same time, these steps ensure that time is not wasted with the energy storage being full and the vessel still on its journey, i.e., ensuring that the vessel remains near port such that it may offload its energy stores as soon as they are full or close enough to full to not warrant further journey time.

The journey may comprise a journey of the vessel from a predetermined start location to one of a set of predetermined end locations.

Step a) may comprise receiving an updated end location of the journey during the journey.

The start and end locations of the journey of the vessel may be specified at the start of the journey. Alternatively, an end location of the journey may be revised or updated one or more times during the journey of the vessel. For example, the end location of the journey may be updated based on demand for energy at a particular port, or the need to perform maintenance on the vessel.

The energy generation may comprise hydro generation of the vessel.

The energy generation may comprise wind generation of the vessel.

The energy generation may comprise solar generation of the vessel.

Optimising energy generation may comprise maximising hydrogen generation of the vessel for each timestep of the journey.

The vessel may harness wind, wave and solar energy in the deep ocean, convert it to hydrogen and/or other forms, and store the hydrogen and/or other energy forms in its hull for transporting to ports or hubs for subsequent energy discharge. The method may therefore route the vessel along a journey to keep the vessel in optimum weather and/or environmental conditions, for example, weather conditions relating to wind, wave and solar to maximise the amount of utilisation of the vessel, i.e., maximise the energy generation capabilities of the vessel along the journey.

The timestep may define a fixed period of time, for example, approximately, exactly or less than 10 hours, approximately, exactly or less than 9 hours, approximately, exactly or less than 8 hours, approximately, exactly or less than 7 hours, approximately, exactly or less than 6 hours, approximately, exactly or less than 5 hours, approximately, exactly or less than 4 hours, approximately, exactly or less than 3 hours, approximately, exactly or less than 2 hours, or approximately, exactly or less than 1 hour.

The timestep defines a period of time which may be varied in length across the journey.

The predetermined number, N, may define the number of time horizons over which to optimise the determination of a set of possible routes for the vessel.

The method may benefit from updating the routing of the vessel at intervals to take into account changing journey requirements and/or journey conditions, which may affect both the end location of the journey and the routes identified to get there. By updating the routing at intervals, i.e., timesteps, the average utilisation of the vessel may be optimised over the course of the journey. The intervals, i.e., timesteps, may be pre-determined and fixed or may vary in length across the course of the journey, for example, 1 hour timesteps for 3 hours, then 3-hour times-steps for 12 hours, then 12-hour timesteps for 2 days). This would enable to algorithm to have finer control of the vessel's movements while also enabling it to look further into the future. By determining a set of possible routes for the vessel to be optimised over N timesteps of the journey, i.e., a horizon of the journey, the method employs a smarter algorithm than when compared to just considering one timestep at a time. This is due to the optimisation taking into account constraints and considerations further downstream, which may significantly affect the average utilisation of the vessel along the journey.

In accordance with the present invention, there is provided a computer readable medium comprising instructions for causing a processor to execute instructions according to one or more of the methods disclosed herein.

In accordance with the present invention, there is provided a trained model for executing step c), wherein step c) may be performed by machine learning.

In accordance with the present invention, there is provided a computer program comprising instructions which, when the program is executed by a computer, cause the computer to carry out one or more of the methods disclosed herein.

In accordance with the present invention, there is provided a control system for routing, for example, remotely, a vessel, the control system comprising one or more processors configured to perform one or more of the methods disclosed herein, for example autonomously, for example by artificial intelligence.

In accordance with the present invention, there is provided a movable maritime vessel for generating, storing and transporting energy, the vessel comprising:

a hull;

at least one sail configured to capture wind energy to move the vessel;

an energy generation system comprising a hydro generator, wherein the hydro generator is configured to generate energy from the movement of fluid, for example sea water, through the hydro generator; and a processor configured to communicate with the control system disclosed herein for routing the vessel.

There is also provided a control system for remotely routing a vessel as described herein and/or for executing any method described herein, for example autonomously, for example by artificial intelligence. This allows for the benefits of the vessel described herein to be optimised based on information and machine learning on location, weather conditions, tides, convenience, etc.

In accordance with the present invention, there are provided methods for routing and/or operating the vessels disclosed herein and/or other suitable such vessels. The methods may be used in conjunction with the other methods disclosed herein. These methods include a port-to-port method of routing and/or operating a vessel, wherein the vessel starts at a port and returns to a port, for example, to and from the same port. Alternatively, the vessel may travel from a first port to a second port.

The methods for routing and/or operating the vessels disclosed herein and/or other suitable such vessels also include an offshore method, wherein the vessel stays out at sea and transfers energy to a point of aggregation, for example, filling up a liquid hydrogen tanker that is strategically located centrally in a location of good weather, for example, optimal weather conditions, for the vessels to fill up the liquid hydrogen tanker.

The methods for routing and/or operating the vessels disclosed herein and/or other suitable such vessels also include a mid-route refuelling method, wherein the vessel rendezvous with other maritime vessel and/or craft at sea to directly fuel the maritime vessel and/or craft, for example, for a journey. This may be achieved as the vessel and the maritime vessel and/or craft are moving along a journey. Alternatively, this may be achieved as the vessel and the maritime vessel and/or craft are bunkering, for example, refuelling while waiting outside a port.

BRIEF DESCRIPTION OF THE DRAWINGS

The present invention will now be described with reference to the accompanying drawings, in which.

DETAILED DESCRIPTION

Movable Maritime Vessel

Figure 1:
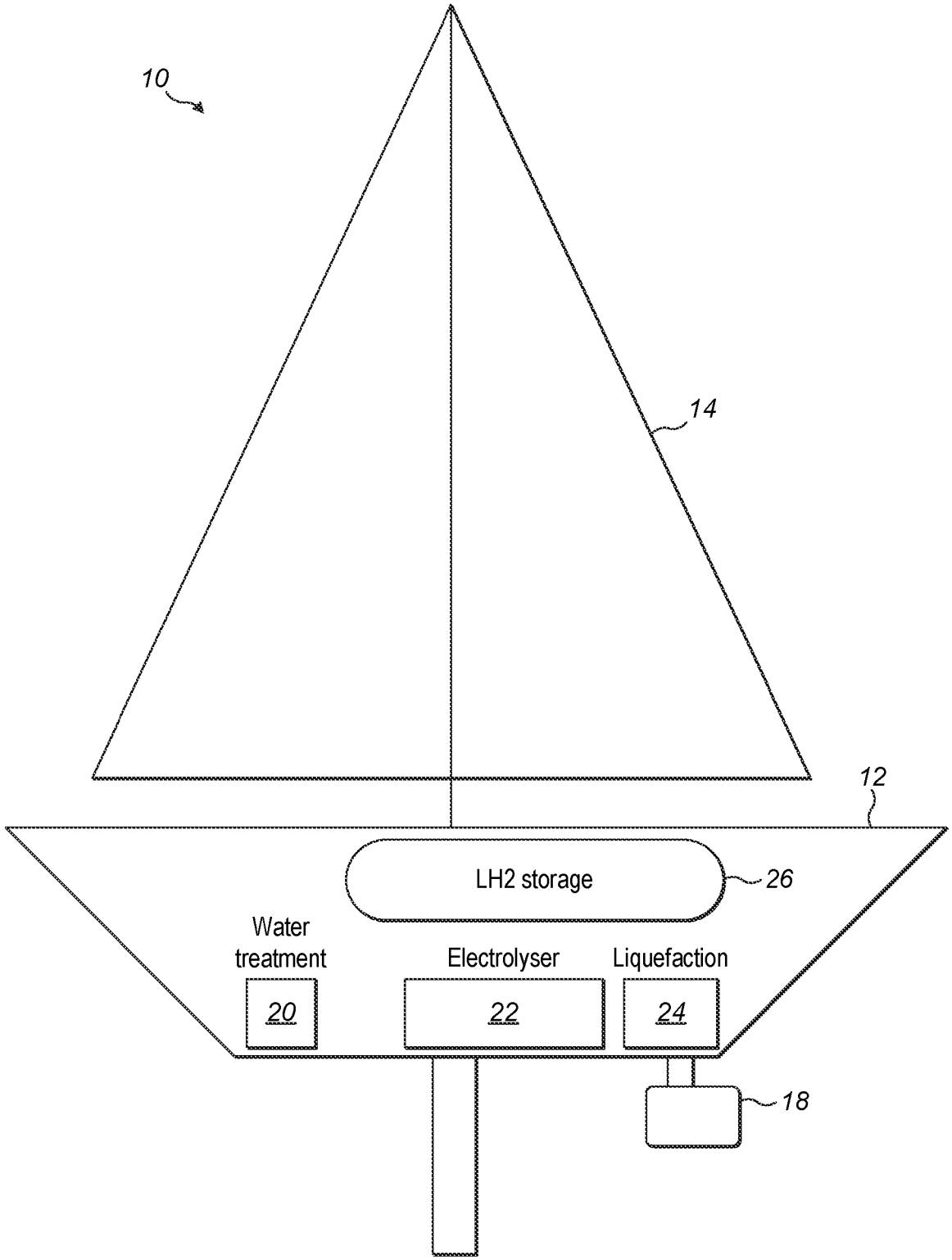
FIG. 1 shows a vessel according to the invention.

FIG. 1 shows a vessel 10 according to the invention. The vessel 10 is movable maritime vessel (e.g. a catamaran or trimaran) for generating, storing and transporting energy. The vessel 10 comprises a hull 12, a sail 14 (although there may be a plurality of such sails) configured to capture wind energy to move the vessel 10 and an energy generation system comprising a hydro generator 18.

The hydro generator 18 is configured to generate energy from the movement of fluid, for example sea water, through the hydro generator 18. Typically, the hydro generator will comprise a turbine (not shown).

In some embodiments, as well as the hydro generator 18, the energy generation system comprises at least one solar panel or an array of solar panels (not shown in FIG. 1).

The vessel 10 further comprises an energy transformation system configured to receive and process energy generated by the energy generation system, the energy generation system including the hydro generator 18. The energy transformation system comprises a water purification plant (or water treatment plant) 20 for purifying or treating liquid, for example sea water. The water purification plant 20 comprises at least one of a filter and a desalination unit (not shown in FIG. 1). The energy transformation system also comprises an electrolysis plant (or electrolyser) 22 for electrolysing liquid received from the water purification plant, and for outputting gas e.g. oxygen gas to atmosphere, and for outputting gas e.g. hydrogen gas to an energy storage system of the vessel as described below. In the embodiment shown in FIG. 1, the energy transformation system also comprises a liquefaction plant 24 for liquefying gas e.g. hydrogen gas received from the electrolysis plant and outputting liquid e.g. liquid hydrogen. As will be described below, there are embodiments where the energy transformation plant will not comprise a liquefaction plant 24

In FIG. 1, the vessel 10 further comprises an energy storage system configured to store energy received from the energy generation system and/or the energy transformation system. In the embodiment shown in FIG. 1, the energy storage system comprises a storage tank 26, for example a cryogenic storage tank, for storing liquid, for example liquid hydrogen, received from the liquefaction plant 24.

Figure 2:
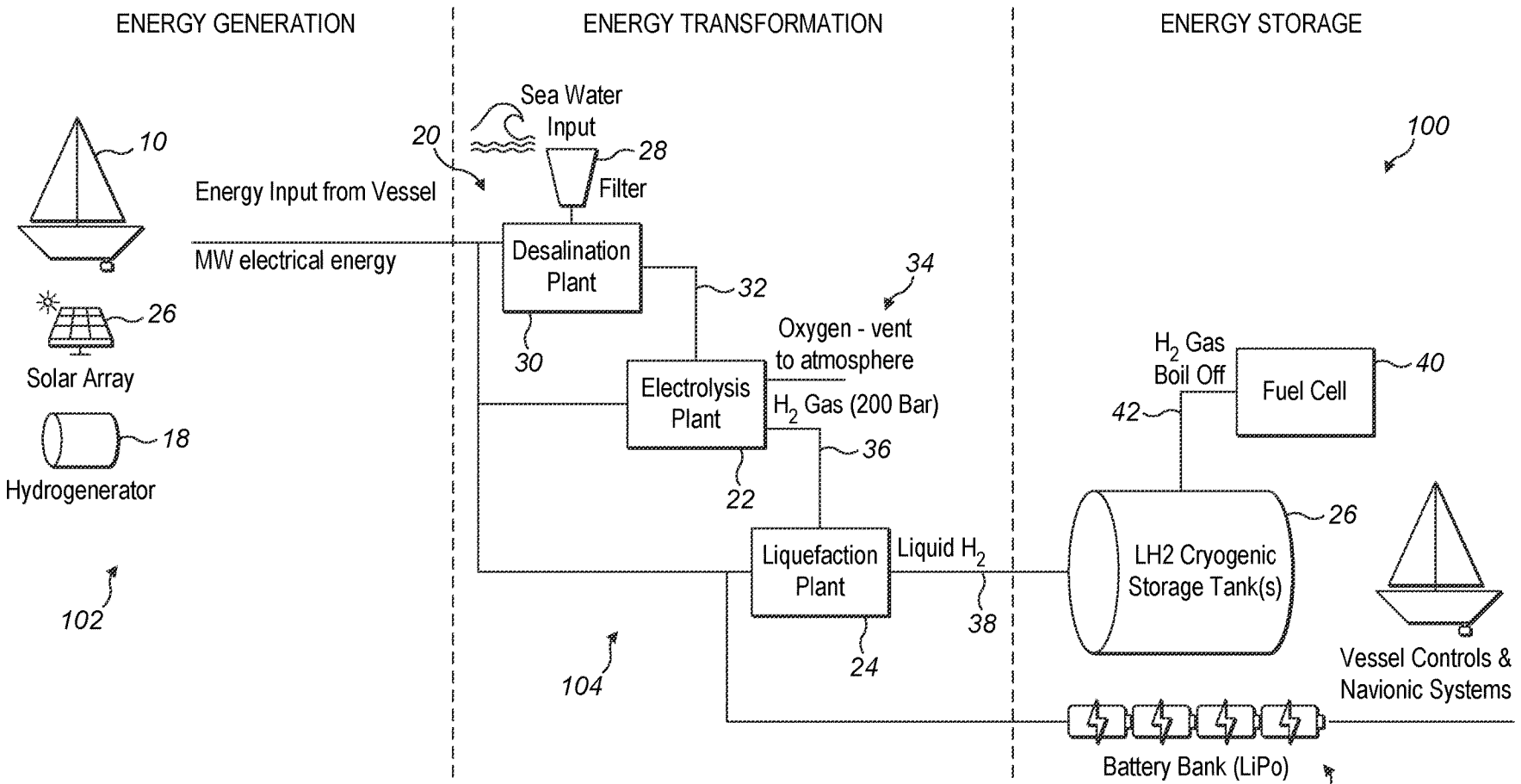
FIG. 2 shows a schematic diagram of a system according to the invention.

FIG. 2 shows a schematic diagram of a system 100 according to the invention, for example with the use of the vessel 10 shown in FIG. 1 and described above. The system 100 comprises an energy generation system 102, an energy transformation system 104 and an energy storage system 106.

In the embodiment shown in FIG. 2, the energy generation system 102 comprises a hydro generator 18 as described previously and at least one solar panel or an array of solar panels 26, although this is not essential. The at least one solar panel or array of solar panels 26 would typically be located on at least one upward facing surface of the hull and/or embedded in the at least one sail, although it will be understood that other locations could be employed.

In the arrangement shown in FIG. 2, the energy transformation system 104 comprises a water purification plant (or water treatment plant) 20 for purifying/treating liquid (as described previously), for example sea water. In the arrangement shown in FIG. 2, the water purification plant 20 comprises a filter 28 and a desalination unit 30, the water purification plant being configured to output purified liquid via a first conduit 32. The energy transformation system also comprises an electrolysis plant (or electrolyser) 22 as described previously for electrolysing liquid received from the water purification plant 20 via the first conduit 32, and for outputting gas e.g. oxygen gas to atmosphere via a second conduit 34, and for outputting gas e.g. hydrogen gas via a third conduit 36.

As well as the water purification plant 20 and electrolysis plant 22 described above, the energy transformation system 104 shown in FIG. 2 further comprises a liquefaction plant 24 as described previously for liquefying gas e.g. hydrogen gas received from the electrolysis plant 22 via the third conduit 36 and outputting liquid e.g. liquid hydrogen via a fourth conduit 38. However, the liquefaction plant 24 is not essential as will be described below.

In the arrangement shown in FIG. 2, the energy storage system 106 comprises a storage tank 26 as described previously, for example a cryogenic storage tank, for storing liquid, for example liquid hydrogen, received from the liquefaction plant 24 via the fourth conduit 36. However, in some embodiments, the energy transformation system 104 does not comprise a liquefaction plant 24. In such cases, the energy storage system 106 comprises a compressor (not shown) configured to receive gas, for example hydrogen gas, from the electrolysis plant 22 via the third conduit 36 and a storage tank for storing the gas.

In the embodiment shown in FIG. 2, the energy storage system 106 further comprises a fuel cell 40, for example a hydrogen fuel cell. The storage tank 26 is configured to output hydrogen gas boil off via a fifth conduit 42. The fuel cell 40 is configured to receive hydrogen gas boil off from the storage tank 26 via the fifth conduit 42.

FIGS. 3 to 6 show arrangements of hull 12 and hydro generator 18 of the vessel 10 according to the invention.

Figure 3:
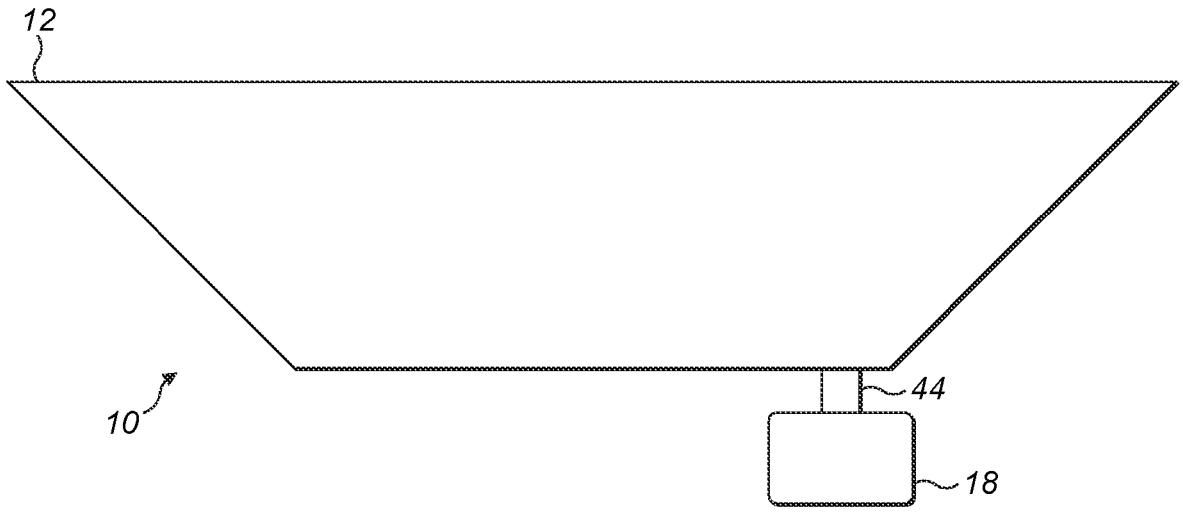
FIG. 3 shows a first arrangement of a hull and hydro generator of a vessel according to the invention.

In FIG. 3, the hydro generator 18 is directly attached to the hull 12 by a flexible or inflexible connector 44.

Figure 4:
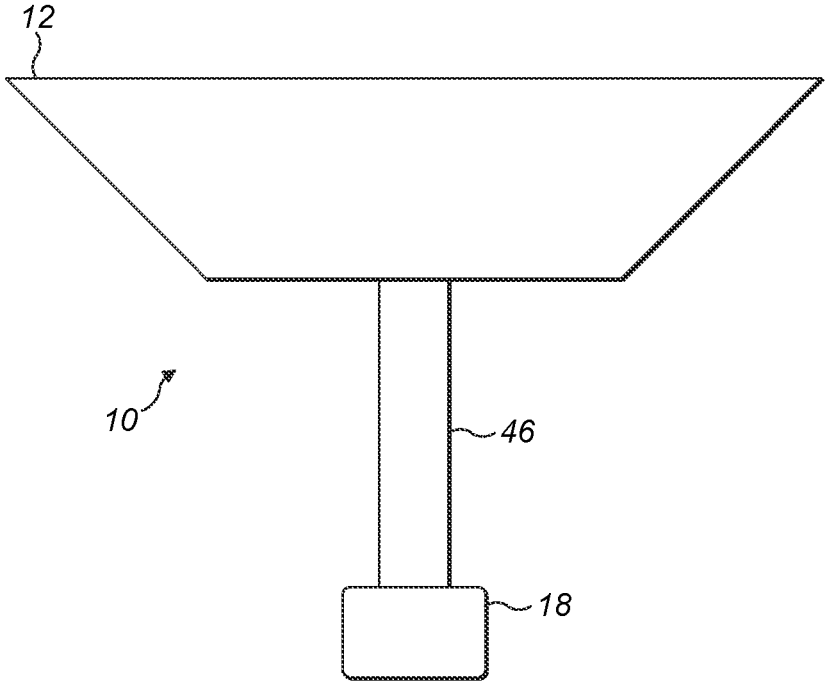
FIG. 4 shows a second arrangement of a hull and hydro generator of a vessel according to the invention.

In FIG. 4, the hydro generator 18 is attached to the hull 12 by a keel 46 of the vessel 10.

Figure 5:
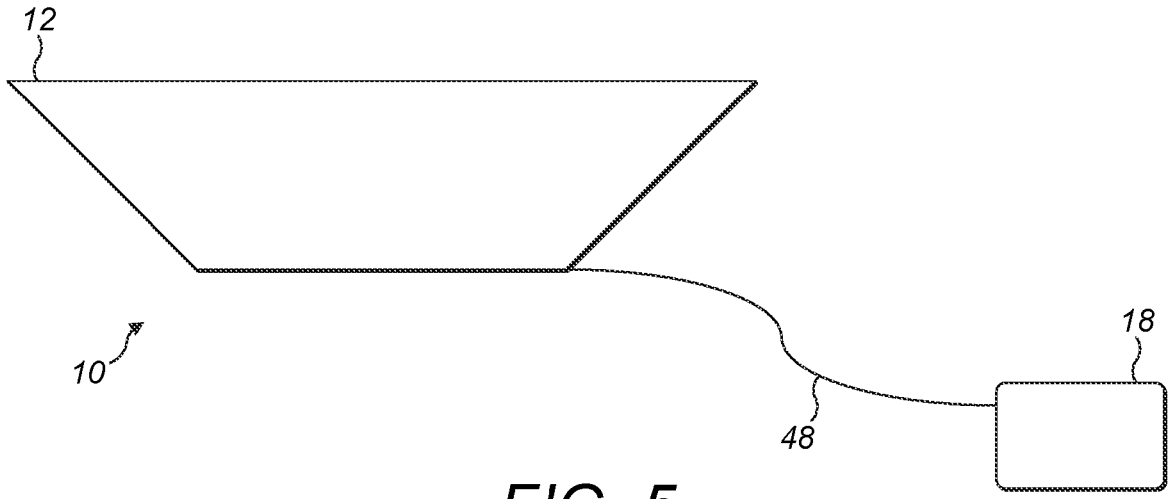
FIG. 5 shows a third arrangement of a hull and hydro generator of a vessel according to the invention.

In FIG. 5, the hydro generator 18 is connected to the hull 12 by a flexible connector 48 and is towed by the vessel 10.

Figure 6:
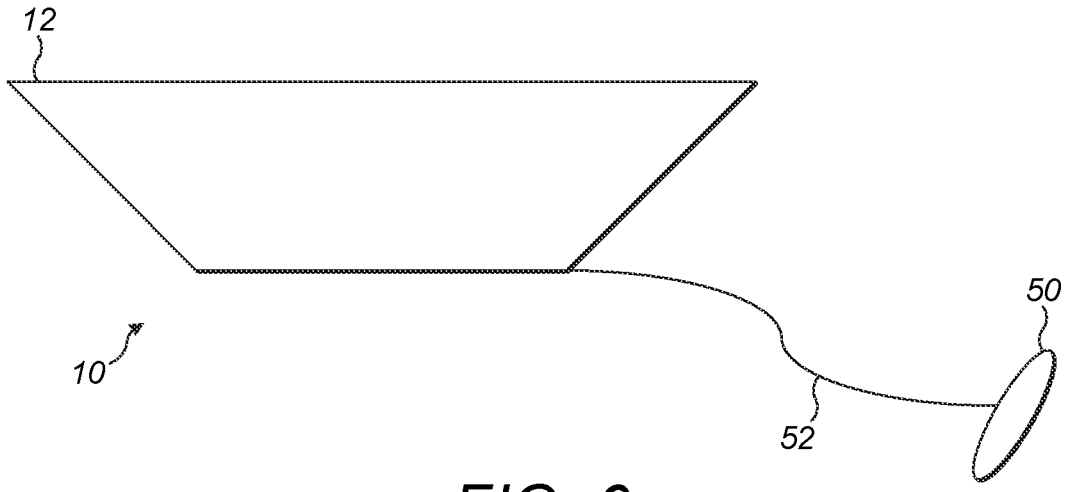
FIG. 6 shows a fourth arrangement of a hull and hydro generator of a vessel according to the invention.

In FIG. 6, the vessel comprises a kite 50, such as a sea kite, that is connected to the hull by a flexible connector 52.

Figure 7:
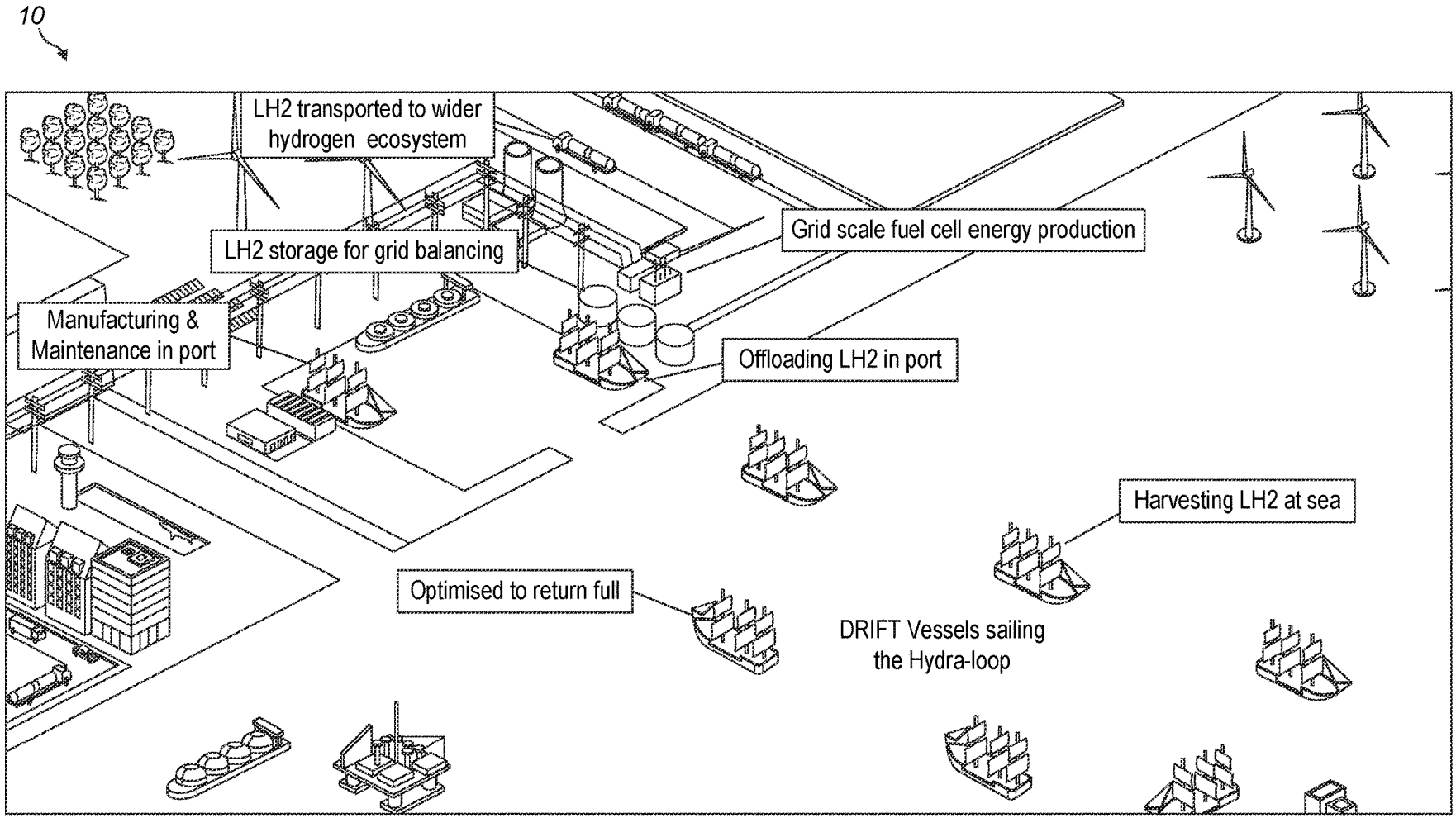
FIG. 7 shows a system and method according to the invention.
Figure 8:
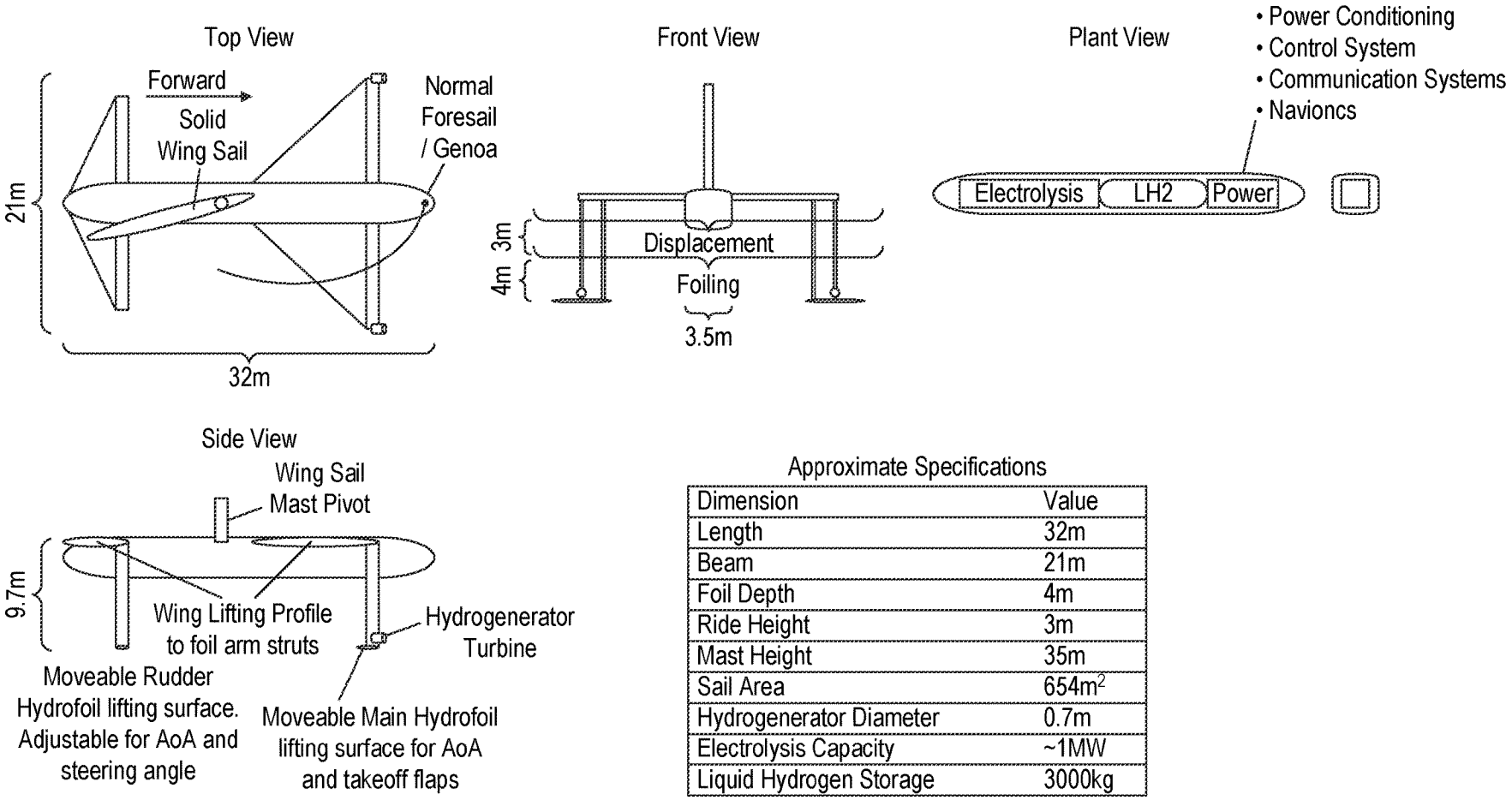
FIGS. 8 and 9 show exemplary technical specifications.
Figure 9:
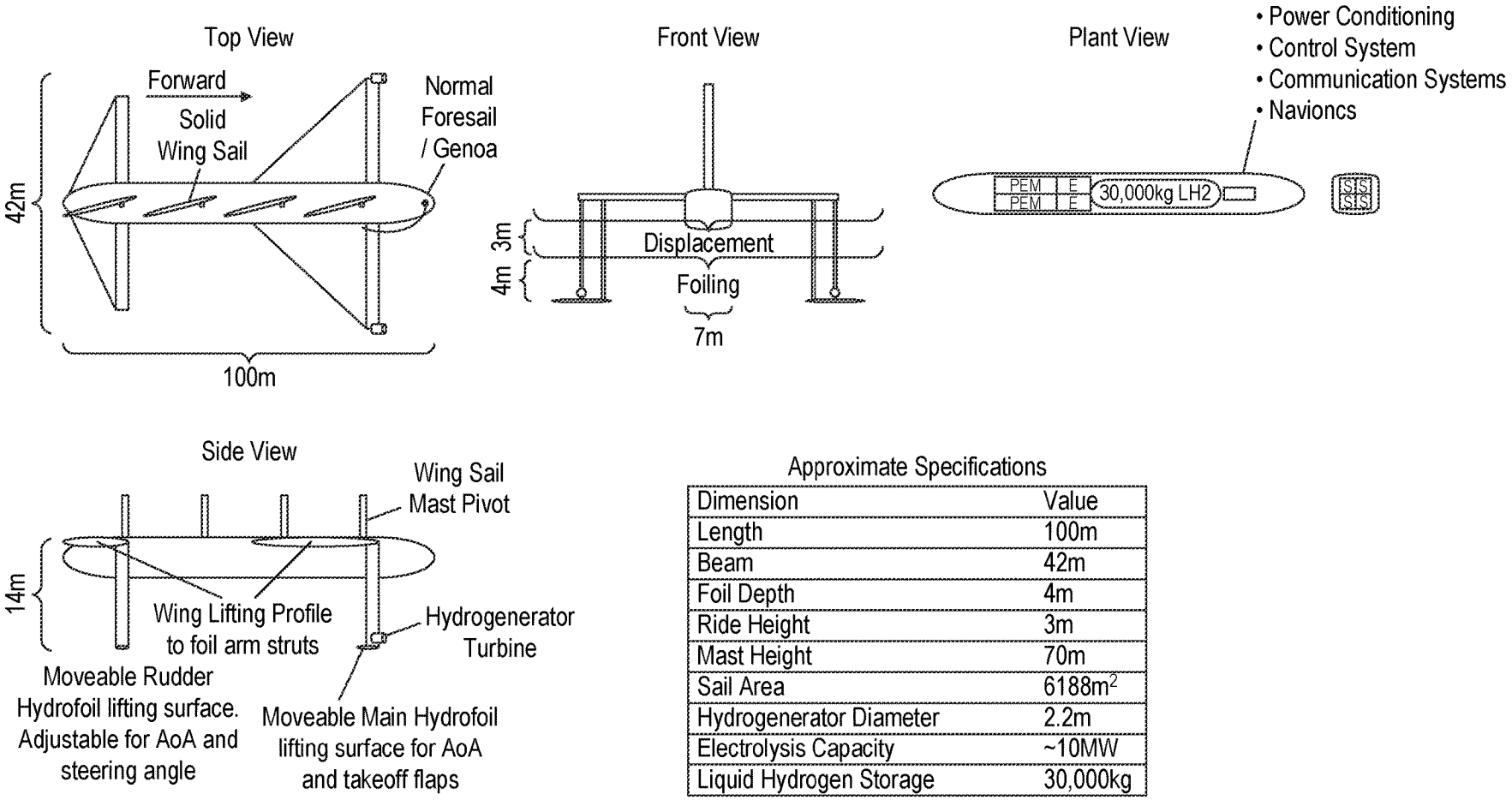
Figure 10:
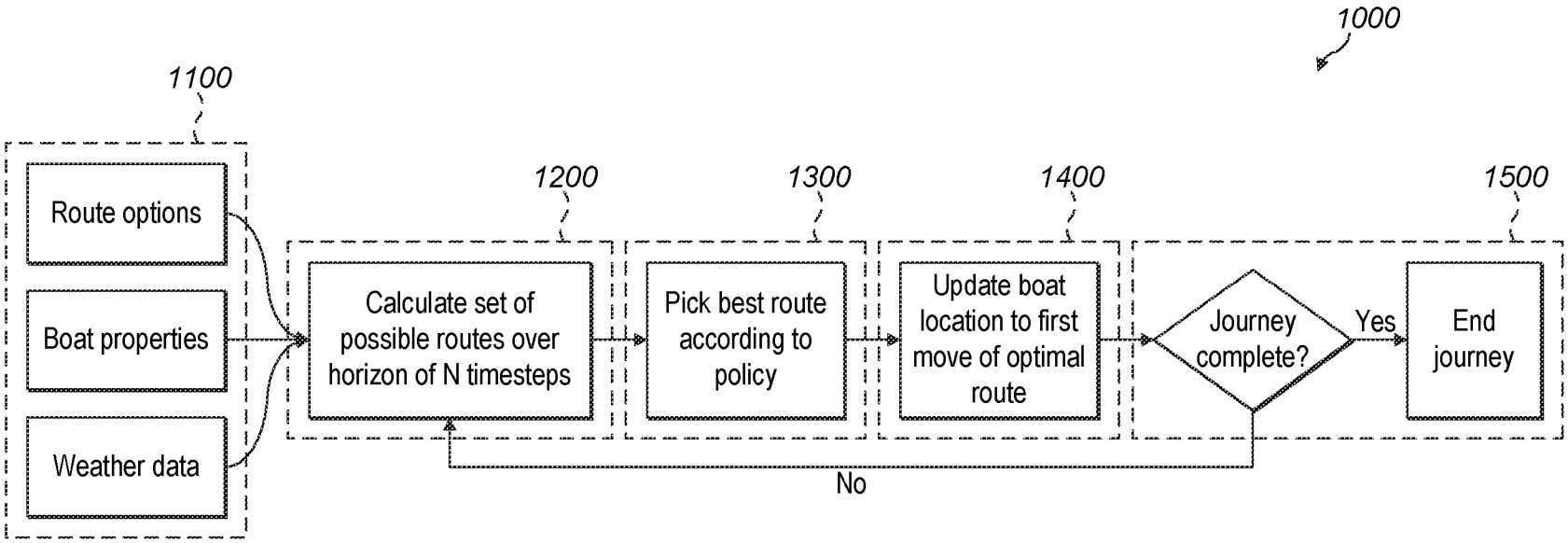
FIG. 10 shows a method of routing a movable maritime vessel to optimise energy generation according to the invention.

FIG. 7 depicts a system and method according to the invention. The vessels 10 according to the invention generate energy as described herein, transform the energy as described herein, store the energy as described herein and transport the energy to port. Typically, the vessels 10 are remotely routed, for example autonomously, for example by artificial intelligence Method for Routing a Movable Maritime Vessel FIG. 10 shows a method 1000 of routing a movable maritime vessel to optimise energy generation according to the invention. The method 1000 provides an algorithm for determining one or more optimal routes for the vessel along a journey of the vessel and is shown at a high level. The method 1000 may comprise five stages 1100, 1200, 1300, 1400, 1500. Alternatively, one or more of the stages 1100, 1200, 1300, 1400, 1500 may be combined.

The first stage 1100 of the method 1000 is an input stage. There may be three primary groups of inputs to the method 1000. These inputs may be related to the vessel itself and/or the journey of the vessel. For example, in the embodiment shown, the inputs include route options, boat properties, i.e., vessel properties, and weather data.

Examples of route options include the starting location of the vessel, i.e., where the vessel starts its journey, the ending location of the vessel, i.e., the desired destination of the vessel, and the start time of the journey, i.e., the planned start time.

Examples of boat properties include the number of discrete sailing angles of the vessel, the horizon over which to optimise, i.e., the number and length of the timesteps for which to determine an optimal set of possible routes for the vessel, the maximum wind speed that may be sailed into, and the utilisation hours of the vessel, i.e., the amount of energy capable of being stored by the vessel, for example, tank volume of the vessel in the case of storing energy as liquid hydrogen.

Examples of weather data include real-time and/or forecasted wind speed and wind direction data.

The second stage 1200 of the method 1000 involves exploring the possible routes that may be taken by the vessel over a given horizon, i.e., a predetermined number of subsequent timesteps, to inform a selection of the most optimal route of the vessel over a next timestep of the journey of the vessel.

The second stage 1200 involves exploring all possible routes from a current location of the vessel for a next timestep, for example, for a 3-hour time interval. This involves calculating the next position of the vessel, the utilisation of the vessel, and the net benefit, i.e., in terms of utilisation and energy generation, for each route. The most optimal routes for this timestep are taken forward, and all possible routes from this set of new locations are calculated for a subsequent timestep. These steps are repeated until N timesteps have been explored, allowing for a determination of a set of possible routes for the vessel for the next N timesteps.

By calculating the net benefit of each route, net scores may be assigned to routes over to individual timesteps, and an aggregate net score may be assigned to the possible routes for the vessel for the next N timesteps. When assigning net scores to each of the set of the possible routes over N timesteps, the weighting of the estimated utilisation, i.e., reward score, and the weighting of the penalty score in a net score function may dictate the behaviour of the vessel and the returned utilisation. The net score accrued by individual steps further into the future can also be down-weighted to account for uncertainty in weather forecasts.

The third stage 1300 of the method 1000 involves identifying the most optimal route to be taken by the vessel over a next timestep. The route from the determined set of possible routes over N timesteps with the highest net benefit, i.e., net score, is chosen.

The fourth stage 1400 of the method 1000 involves following the identified route and updating the location of the vessel after navigating the vessel according the identified route. Having chosen the best route, optimised over N timesteps, the vessel may be moved, i.e., navigated, to the end of the first timestep of that journey. Only a single timestep is used for routing the vessel as the weather forecast that informs the routing may change in the next timestep, and the next move should include information from the N+1th timestep.

The fifth stage 1500 of the method 1000 involves determining whether the vessel has completed its journey. After every location update of the vessel, it is checked to see if the vessel has reached the end of its journey, for example, whether the vessel has returned to port. If the vessel has not reached the end of its journey, for example, has not returned to port, the method 1000 may be looped until the vessel has reached the end of its journey.

In an embodiment, to be considered "at port", the vessel must be within a 100 nautical mile radius of a predetermined end location of the journey and have at least 95% energy storage, for example, 95% of a full tank in the case of storing energy in the form of liquid hydrogen.

Figure 11:
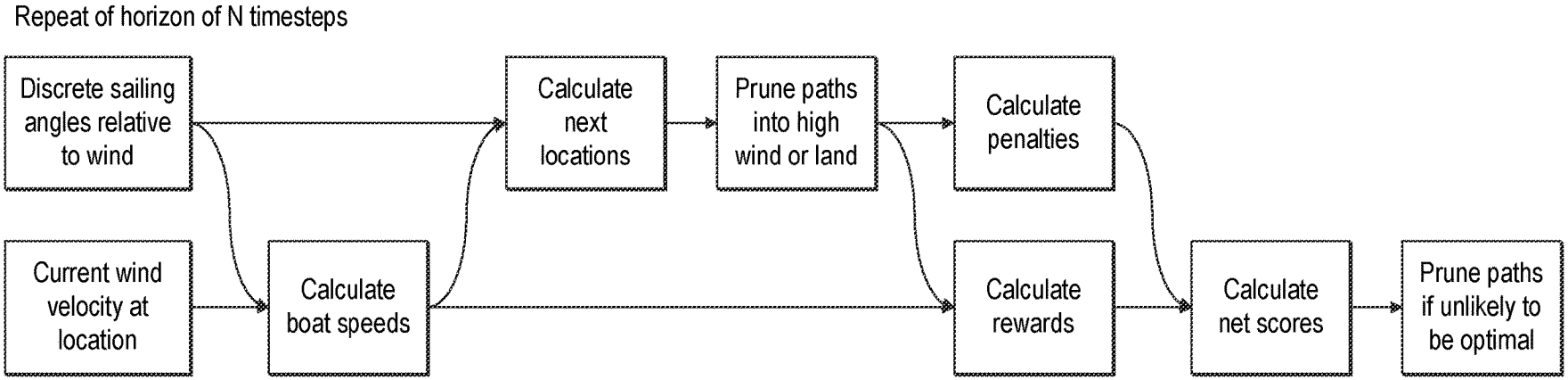
FIG. 11 shows a route discovery stage of a method of routing a movable maritime vessel to optimise energy generation according to the invention.

FIG. 11 shows the second stage 1200 of the method 1000, i.e., the route discovery stage of the method 1000.

As touched on above, the second stage 1200 of the method 1000 explores possible routes that the vessel could take over the following N timesteps. At the end of this process a set of possible routes optimised over N timesteps have been determined, and the rewards, penalties and net scores are calculated for each route.

In an embodiment, at the start of the second stage 1200, the possible sailing angles of the vessel relative to the wind are calculated, and the current wind speed is obtained. From this, the possible vessel speeds for each sailing angle, and the subsequent vessel location after one timestep, for example, 3 hours, of sailing is calculated.

These locations are then checked for two criteria. Firstly, whether the location is within a defined polygon (i.e., not on land), and secondly, whether the wind speed at the location at the end of the next timestep exceeds the maximum wind speed that the vessel can sail into.

Subsequently, a penalty is calculated for each route based on how far from the end location of the journey the location of the vessel at the end of the route is. This penalty increases in strength as the amount of energy stored by the vessel, for example, in a liquid hydrogen tank, fills. This penalty encourages the vessel to return to port as it becomes full. A reward score is calculated for each route using a sigmoid curve that relates vessel speed to utilisation.

The net score for each route is a combination of the reward score and the penalty score. In an embodiment, the final step of the second stage, or the first step of the third stage, is to estimate the best-case and worst-case utilisations, i.e., rewards, for each route over the N timesteps. Routes for which the best-case utilisation is worse than the route with the highest worst-case utilisation are pruned.

Figure 12:
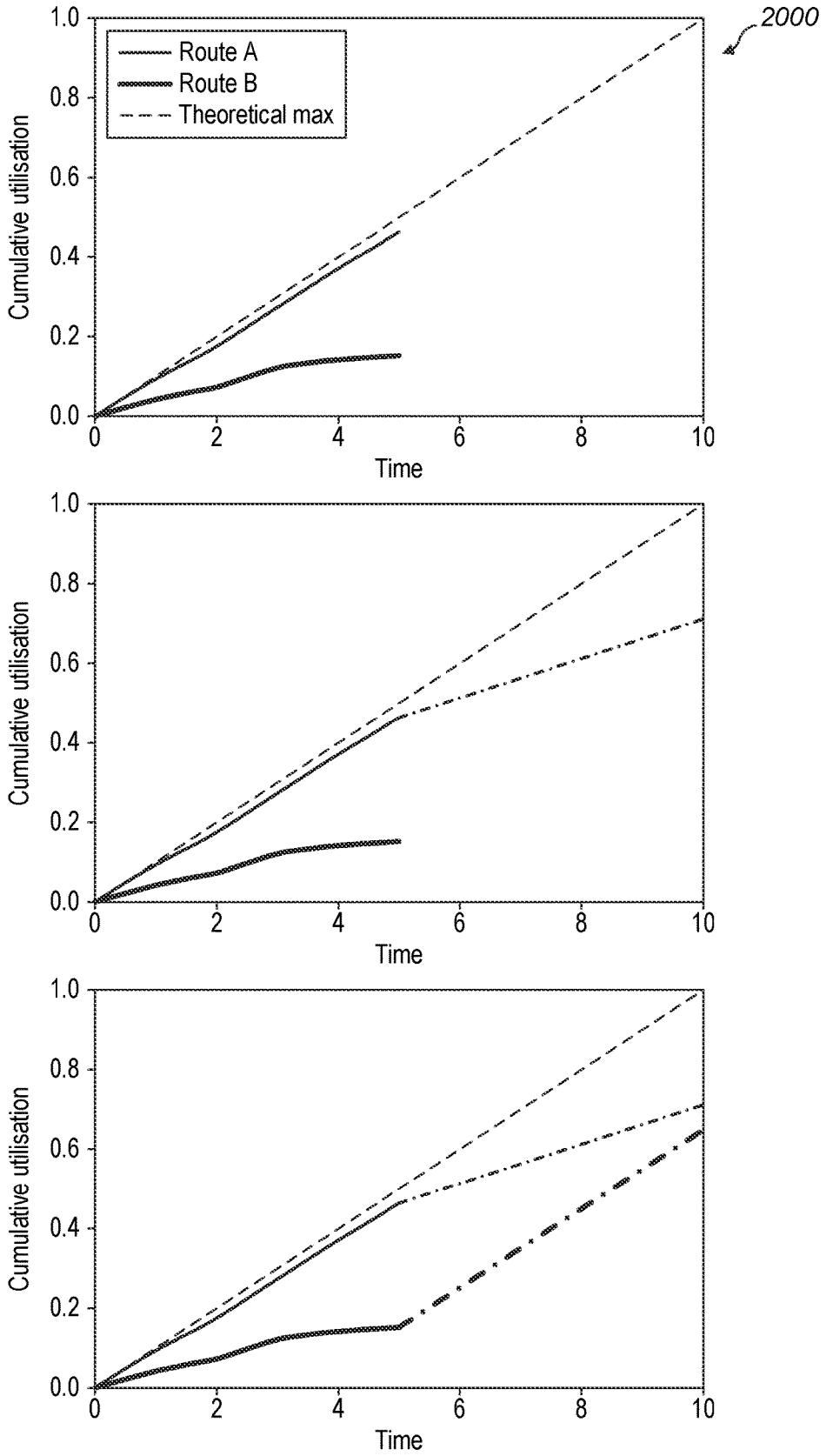
FIG. 12 shows graphs representing a branch and bound algorithm according to the invention.

FIG. 12 shows graphs 2000 representing a branch and bound algorithm according to the invention. The estimation of best-case and worst-case utilisations for each route may be done using a known approach called the branch and bound algorithm. Employing the algorithm can filter down the set of possible routes being explored. As shown in the graphs, two routes are being investigated as options, A and B, with their utilisations over 5 future timesteps being explored. Estimate a worst-case scenario for the current best route (Route A) is that it only achieves 50% utilisation at every subsequent timestep. Estimate a best-case scenario for Route B is that it achieves 100% utilisation at every subsequent timestep. Doing this, it can be seen that Route B is never better than Route A, and so Route B can be discarded as an option.

Figure 13:
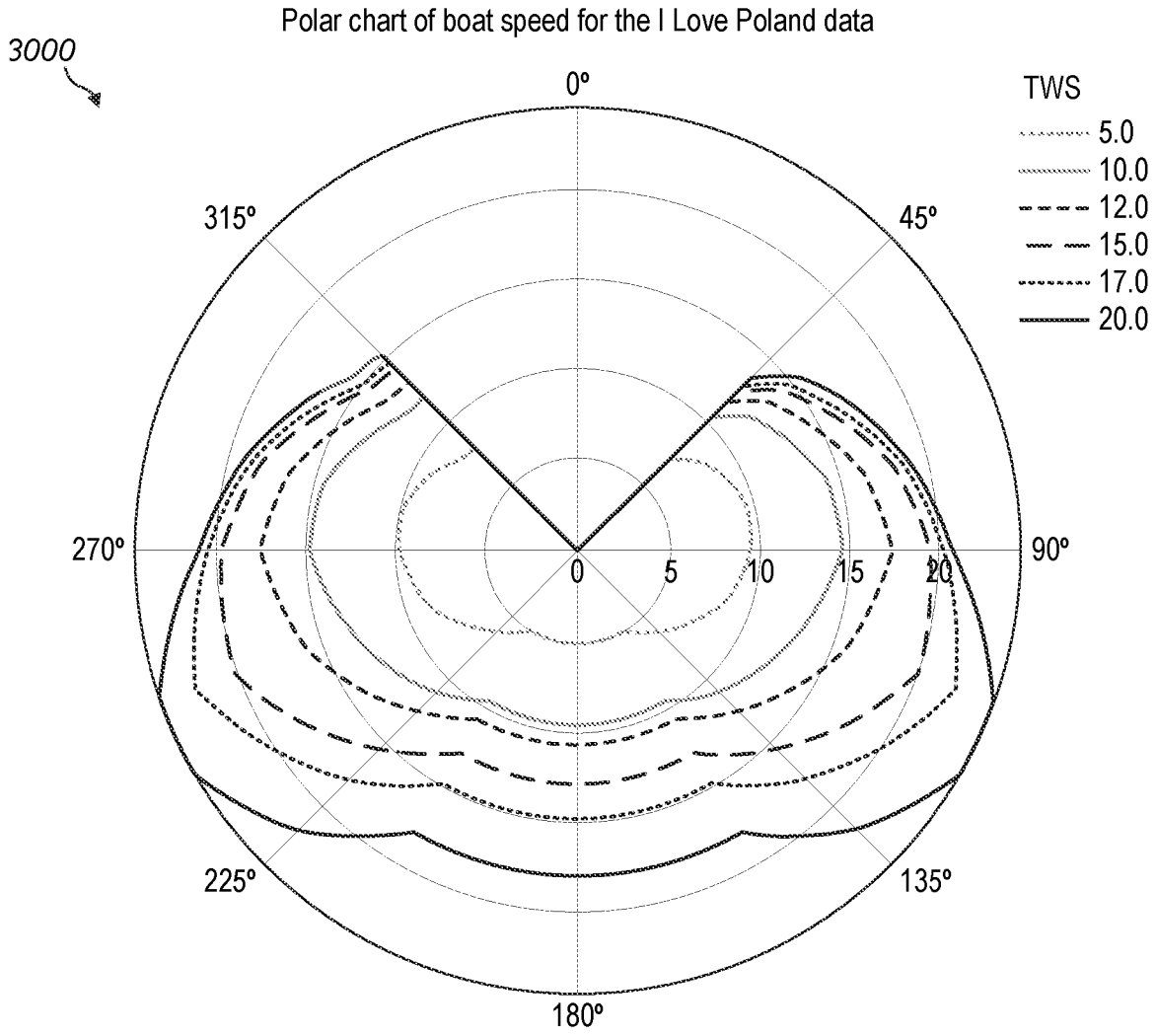
FIG. 13 shows a graph of vessel speeds for various wind speeds and sailing angles according to the invention.
Figure 14:
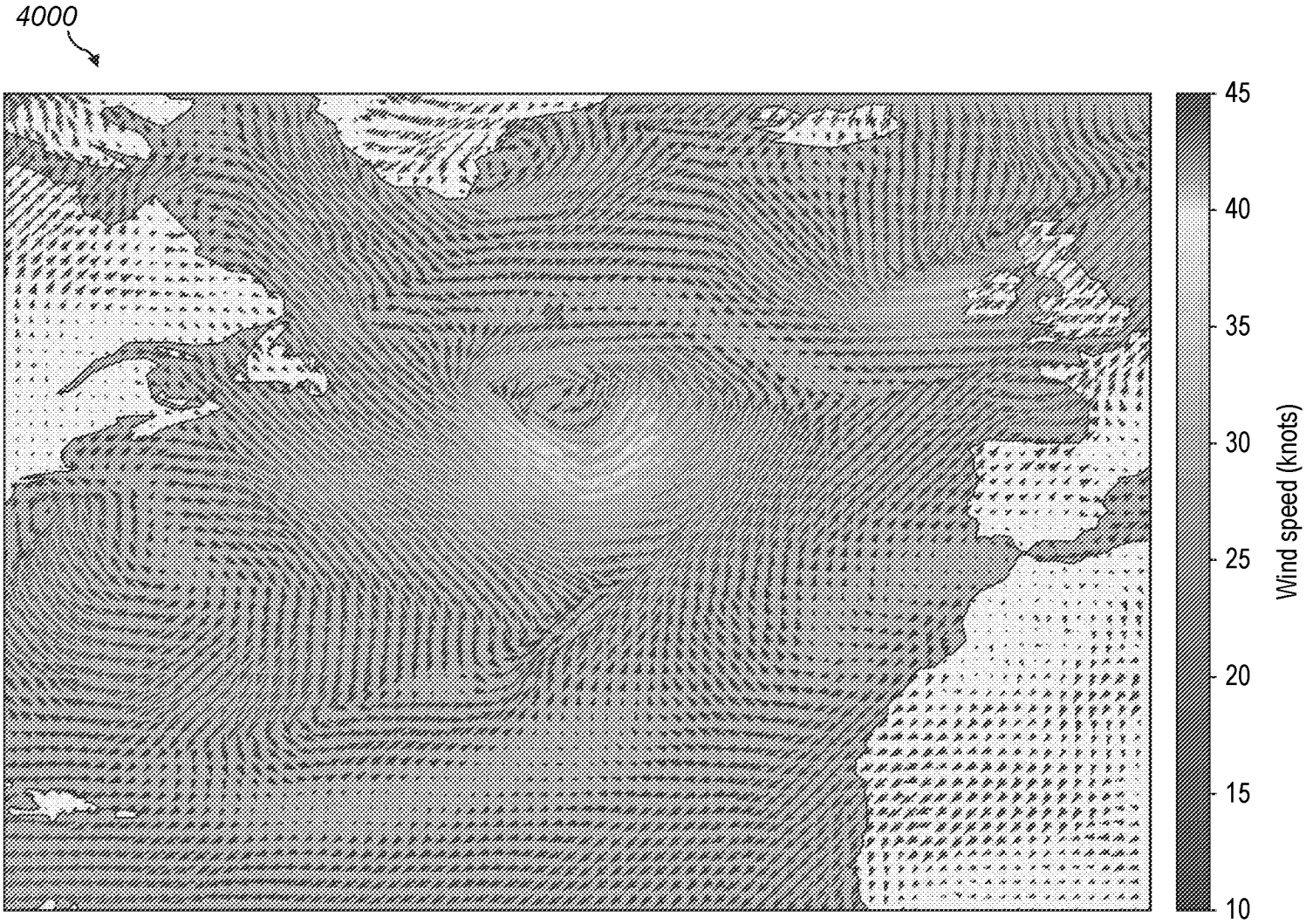
FIG. 14 shows a graph of wind speeds and directions for various locations according to the invention.
Figure 15:
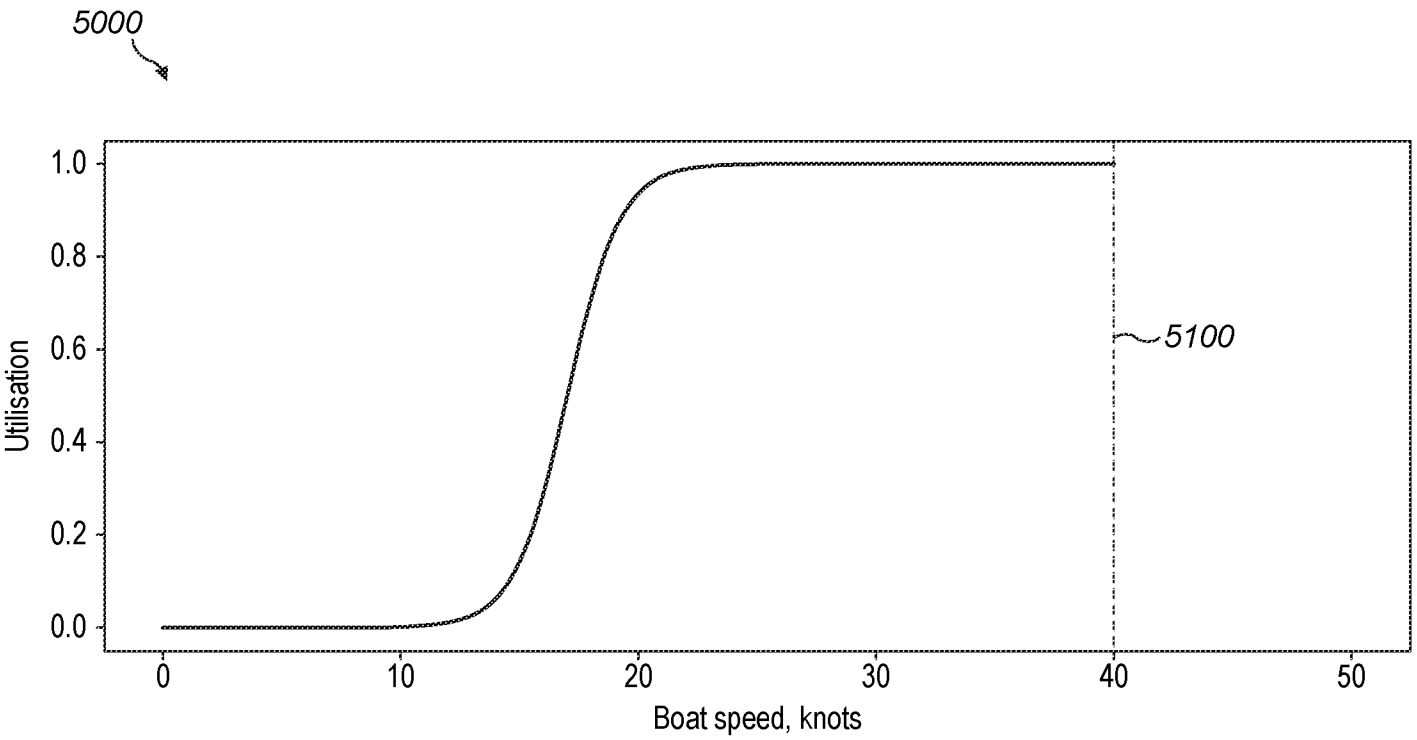
FIG. 15 shows a sigmoid curve relating vessel speed to utilisation for various vessel speeds according to the invention.

FIG. 13 shows a graph 3000 of vessel speeds for various wind speeds and sailing angles according to the invention. FIG. 14 shows a graph 4000 of wind speeds and directions for various locations according to the invention. FIG. 15 shows a sigmoid curve 5000 relating vessel speed to utilisation for various vessel speeds according to the invention. The graph may include a predetermined high wind speed cut-off point 5100 at which the energy generation system of the vessel is turned off. FIGS. 13, 14 and 15 represent exemplary data that may be included in the one or more inputs to the method 1000, for example, for the second stage 1200, i.e., the route discovery stage.

Figure 16:
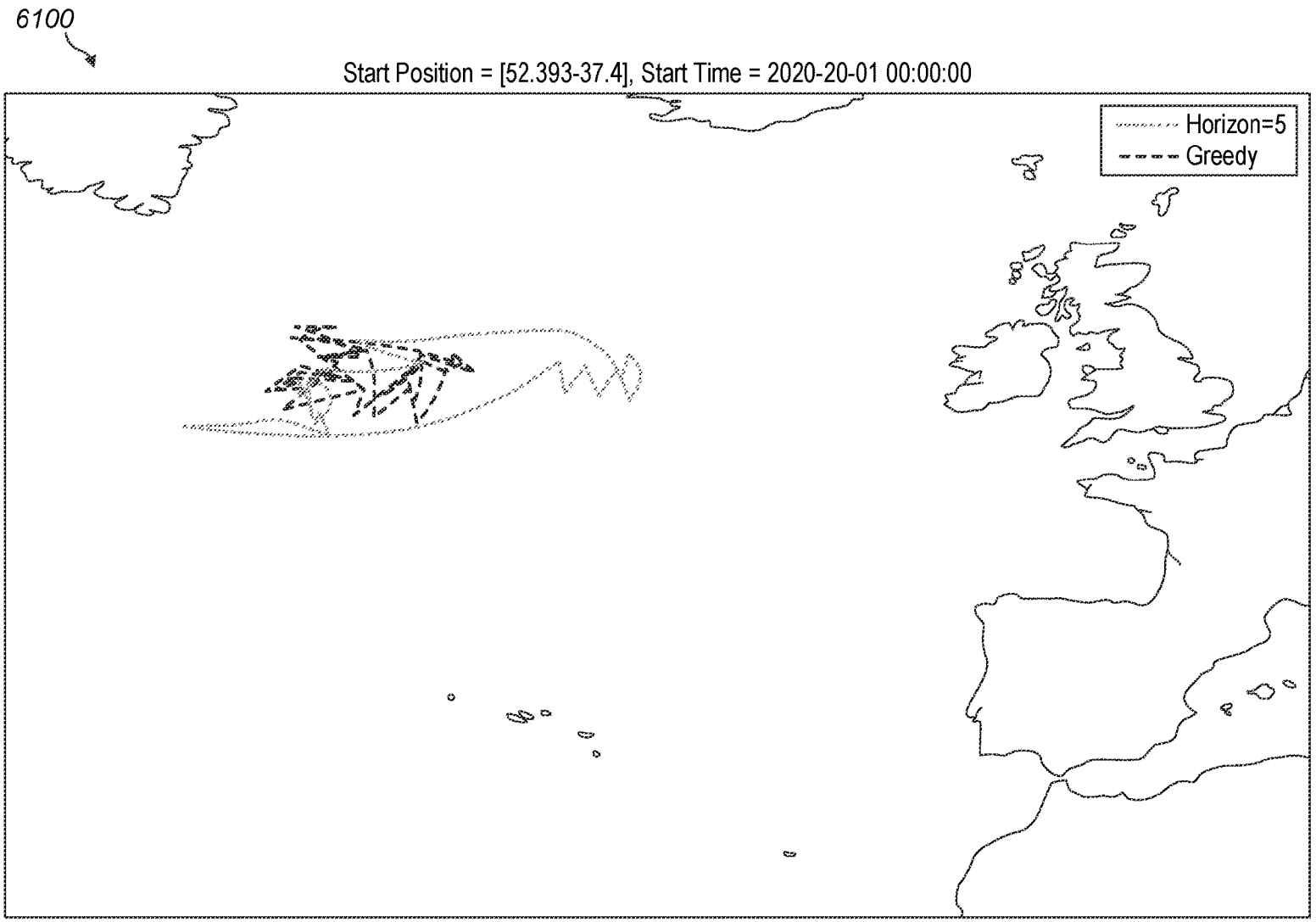
FIG. 16 shows graphs comparing energy generation for each of a greedy routing algorithm and a smart routing algorithm according to the invention.
Figure 16:
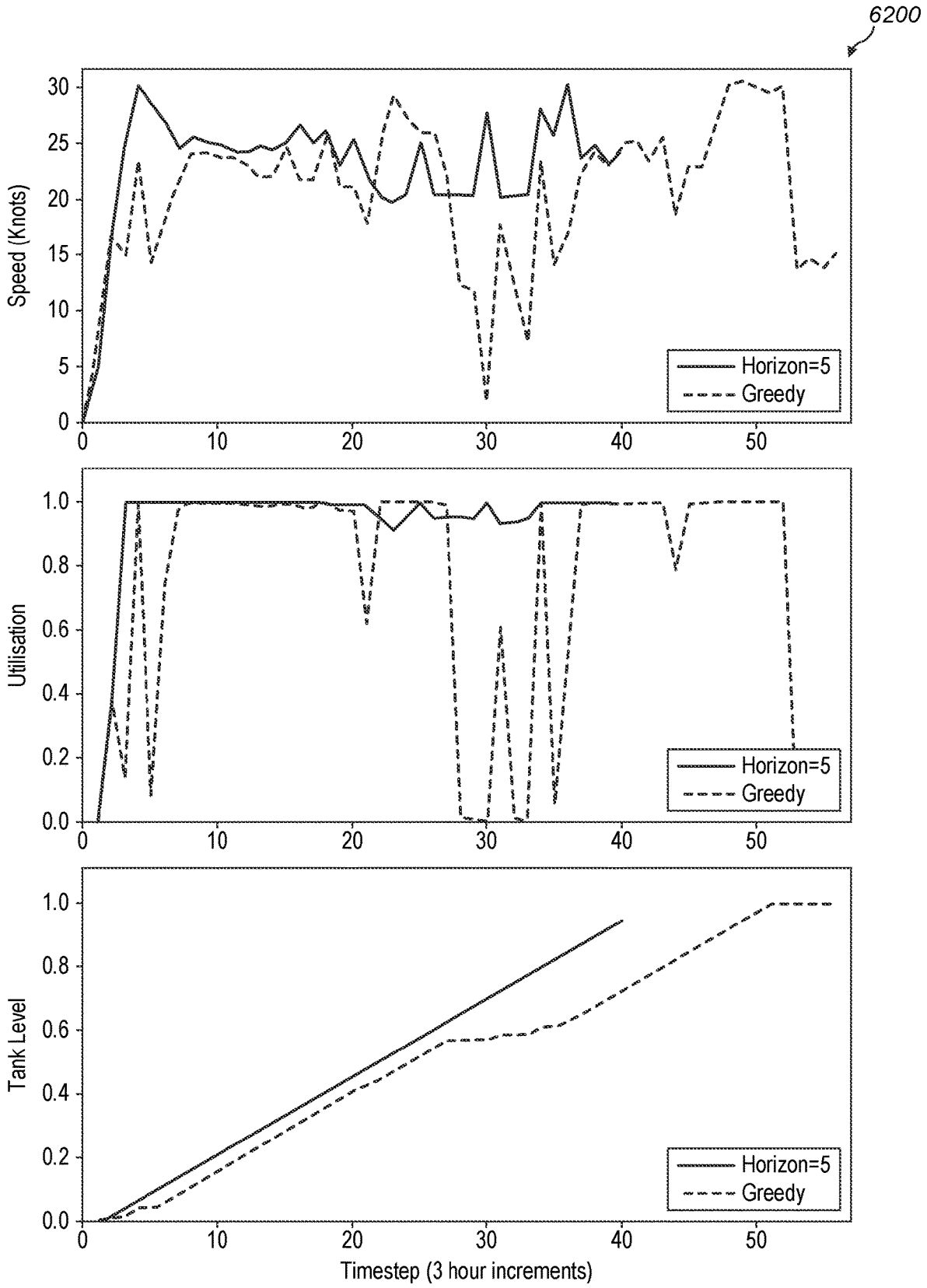
Figure 17:
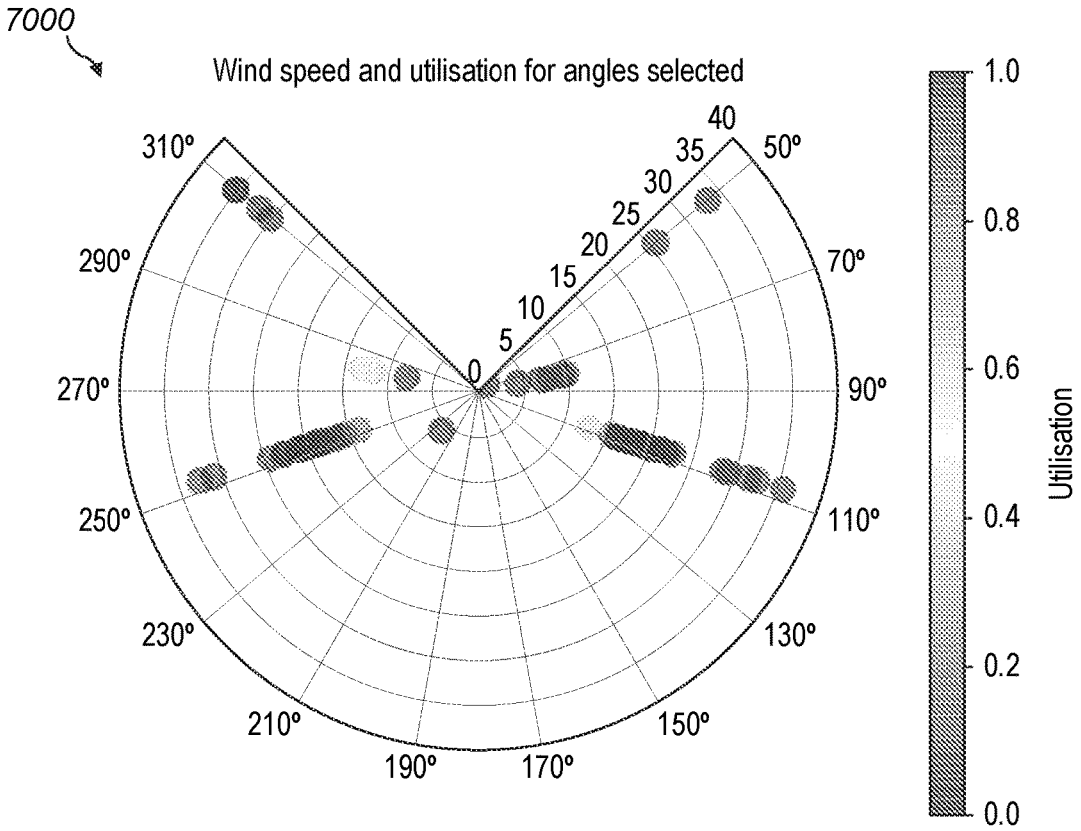
FIG. 17 shows further graphs comparing energy generation for each of a greedy routing algorithm and a smart routing algorithm according to the invention.
Figure 17:
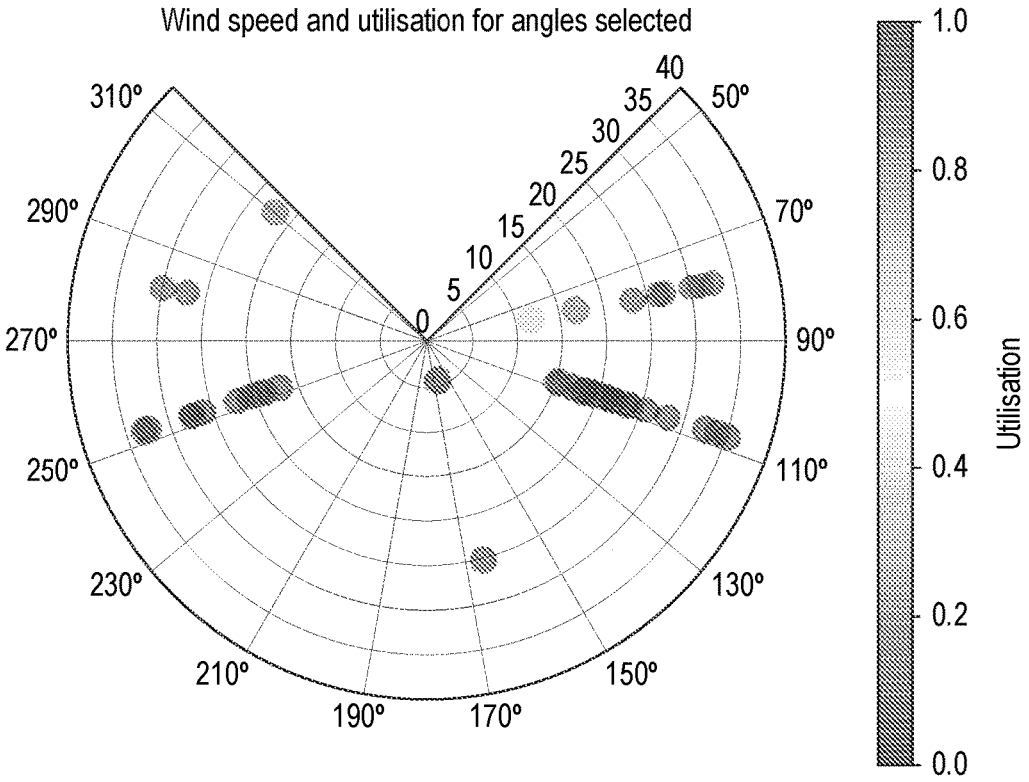

FIG. 16 shows a map 6100 for routes of each of a greedy routing algorithm and a smart routing algorithm according to the invention graphs. FIG. 16 also shows graphs 6200 comparing energy generation for each of a greedy routing algorithm and a smart routing algorithm according to the invention. FIG. 17 shows further graphs 7000 comparing energy generation for each of a greedy routing algorithm (left) and a smart routing algorithm (right) according to the invention.

A greedy algorithm, the routing of which is reflected in the dashed line in the graphs of FIG. 16, is that which fails to consider a horizon of multiple timesteps when determining a route of the vessel to optimise energy generation, and instead attempts to maximise energy generation by considering the next timestep only. By comparison, a smart algorithm, such as method 1000, the routing of which is reflected in the solid line in the graphs of FIG. 16, is that which considers a horizon of five timesteps when determining a route of the vessel to optimise energy generation. As can be seen from the graphs, the greedy algorithm can be caught in an area with low wind speed which is avoided by the smart algorithm, and the smart algorithm fills its energy stores over ten timesteps ahead of its greedy equivalent. The graphs of FIG. 16 the wind speed (in knots) and direction the vessel is travelling in for the same journey with both the greedy and smart algorithms. The shading indicates the vessel's speed (red indicates low speed and green indicates high speeds). In the case of the greedy algorithm, it can be seen that the vessel finds itself in low wind speed regions with low utilisations. In the case of the smart algorithm, it can be seen that the vessel finds itself in high wind speed regions with high utilisations.

The present invention has been described above in exemplary form with reference to the accompanying drawings which represent a single embodiment of the invention. It will be understood that many different embodiments of the invention exist, and that these embodiments all fall within the scope of the invention as defined by the following claims.

Exemplary Results of the Invention

Trials performed managed to produce approximately six litres of green hydrogen over a two-hour test run. The energy yacht outperformed expectations and it was thought that it could have produced over ten times more of the renewable gas. This is equivalent to charging twenty smartphones.

The power of data has been used to find optimal weather conditions in which to route the vessels when at sea. This routing algorithm makes green energy mobile.

There has been a focus not only on ocean class vessels that create renewable energy, which is then converted into hydrogen, but also on using data to find optimal wind speeds to create, store and distribute hydrogen.

It was found that a flotilla of energy yachts using at least some aspects of the invention could achieve a load factor of 72.5 percent. This means that energy vessels according to at least some aspects of the invention are capable of working at full capacity roughly five days a week.

By comparison, verified load factors for wind turbines in the UK are 26.5 percent for onshore wind farms and 39.9 percent for offshore wind farms (operational 2-3 days per week) It has been found that routing, as described according to at least some aspects described herein, can continually optimise the course of the vessels to maintain the highest possible utilisation of the ship.

Routing Examples

The following examples investigate the impact of varying a single parameter at a time on the utilisation recorded by the vessel.

Figure 18:
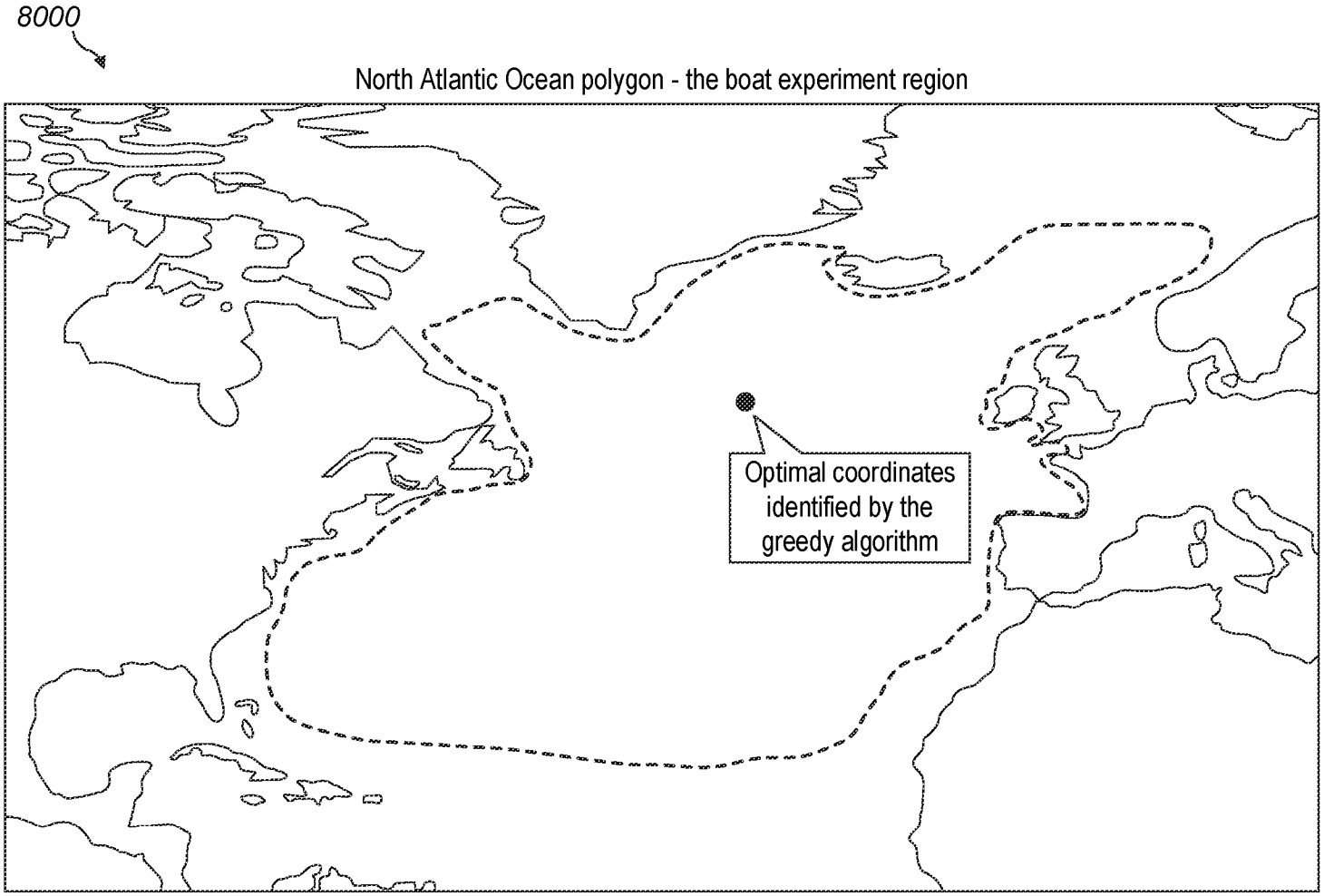
FIGS. 18 to 33 show exemplary data according to the invention.

All examples ran for a minimum of 50 weeks from 1 Jan. 2020. The results discussed below show the utilisation for a single vessel running continuously over this time period, with 6 hours downtime between journeys. The default parameters were used for all other inputs other than the parameter in question. Because each parameter combination in each example is measured by a single run (i.e., one year's worth of operation) the results may be susceptible to local conditions particular to that run. These examples should therefore not be used to identify optimal parameter combinations, but rather to obtain a quick understanding of how this parameter may impact the behaviour of the vessel. A map 8000 of the boundaries of the region the routes ran in the example are shown in FIG. 18.

Figure 19:
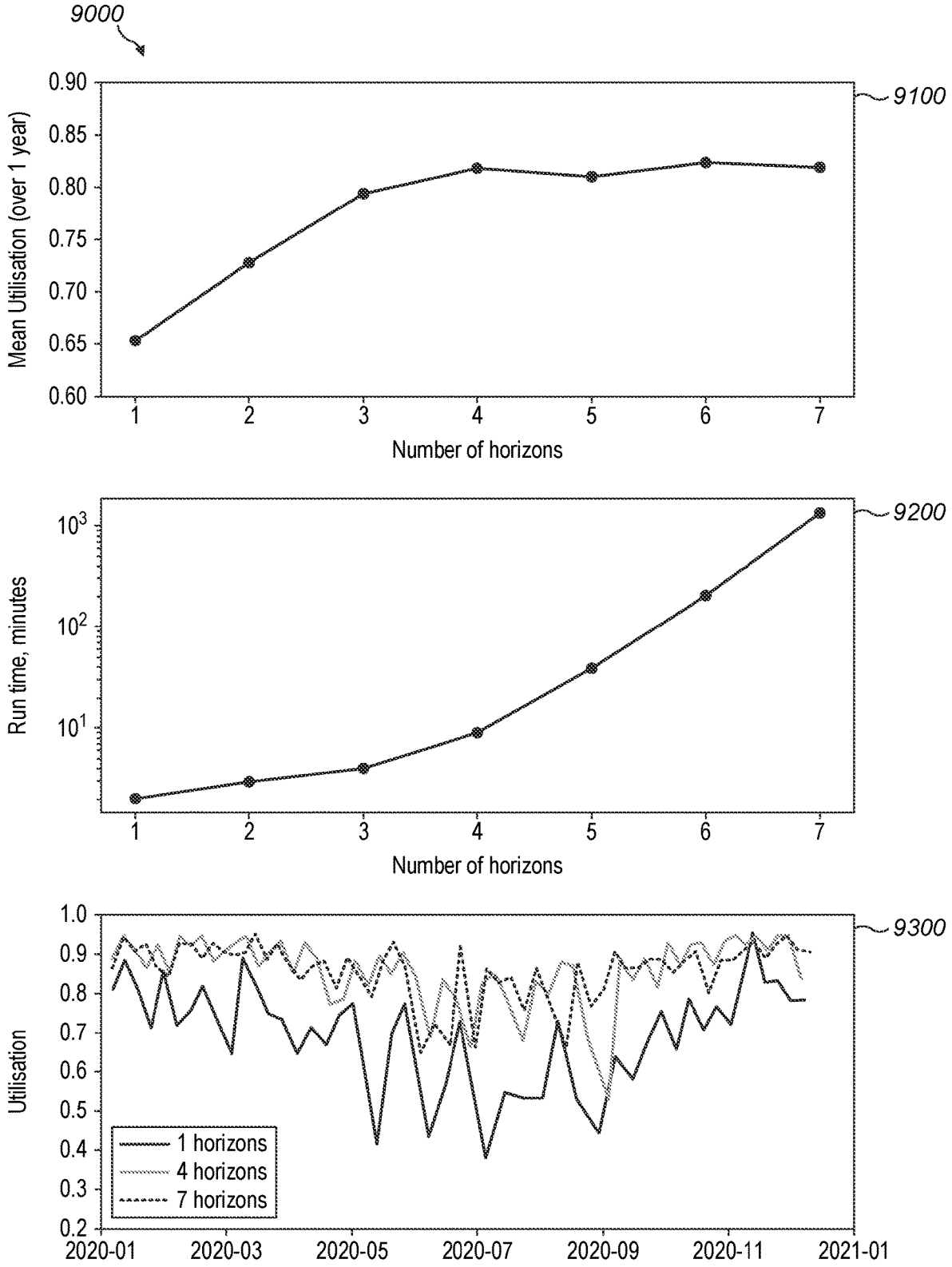

In an example that assesses the impact of increasing the number of time steps considered in the route optimisation, it has been observed that as the time horizon over which to determine a set of possible routes for the vessel to be optimise energy generation increases, the mean utilisation improves but to the detriment of the run time which increases (to over 1000 minutes for 7 timesteps). See graphs 9100, 9200 of FIG. 19. Accordingly, there may be little benefit in increasing a time horizon beyond four to six timesteps (12-18 hours in the case of 3-hour timesteps) as the utilisation improvements tails off beyond this range. This is shown It has also been observed that the utilisation of the vessel is better in winter months than when compared to summer. For the examples, a time horizon of 6 timesteps (18 hours) was selected as a good balance between optimal utilisation and run times. Graph 9300 of FIG. 19 shows the utilisation of individual journeys throughout the year for vessels operating with different number of horizons to optimise over. The vessel has noticeably poorer performance in the summer months when compared to winter. The greedy algorithm (i.e., chooses the best move available at the time) has much bigger variation in performance, particularly in summer months where it can often get stuck in low wind areas. By optimising over more timesteps, the vessel is able to avoid the low wind regions more successfully.

Figure 20:
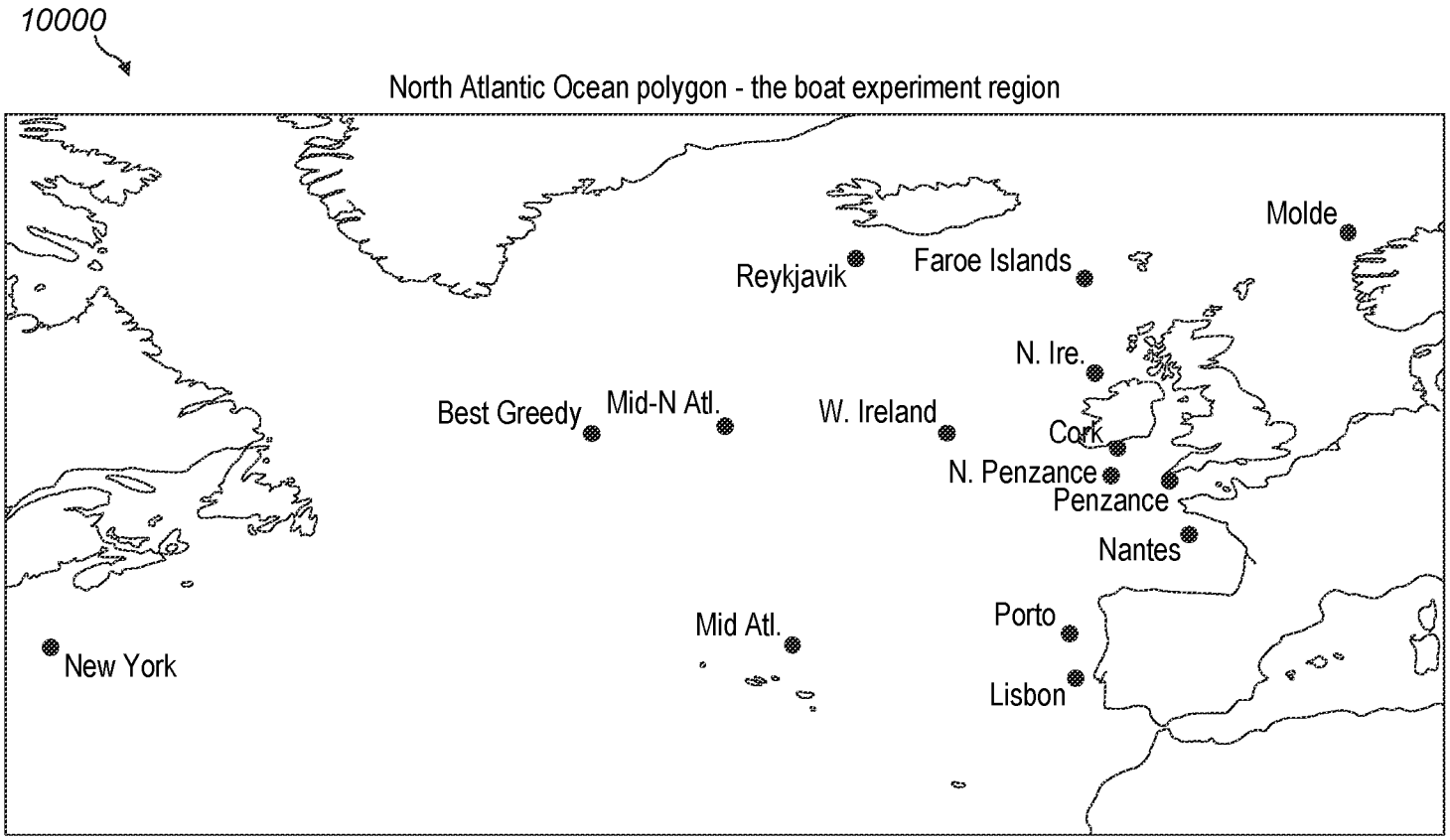
Figure 21:
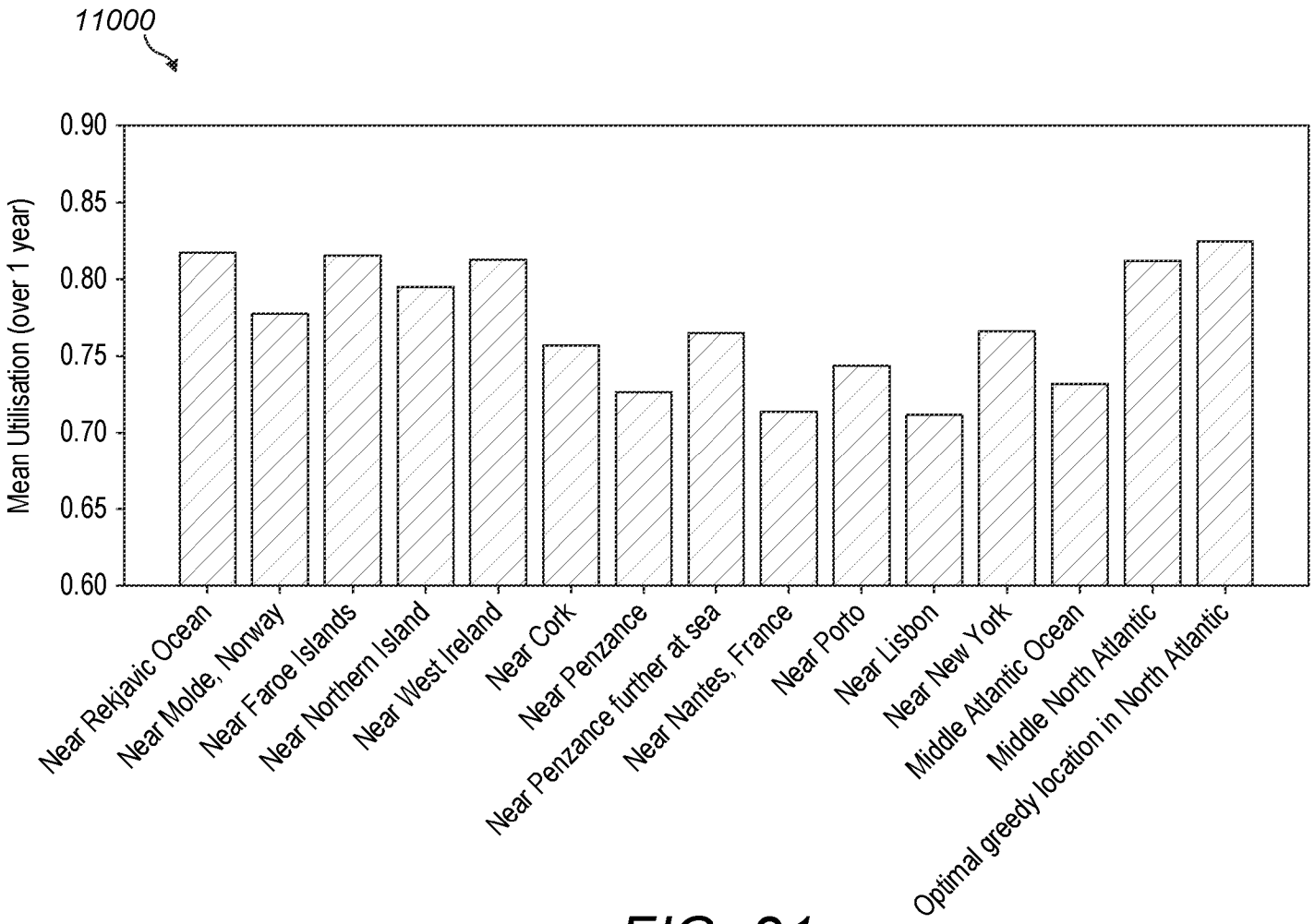
Figure 22:
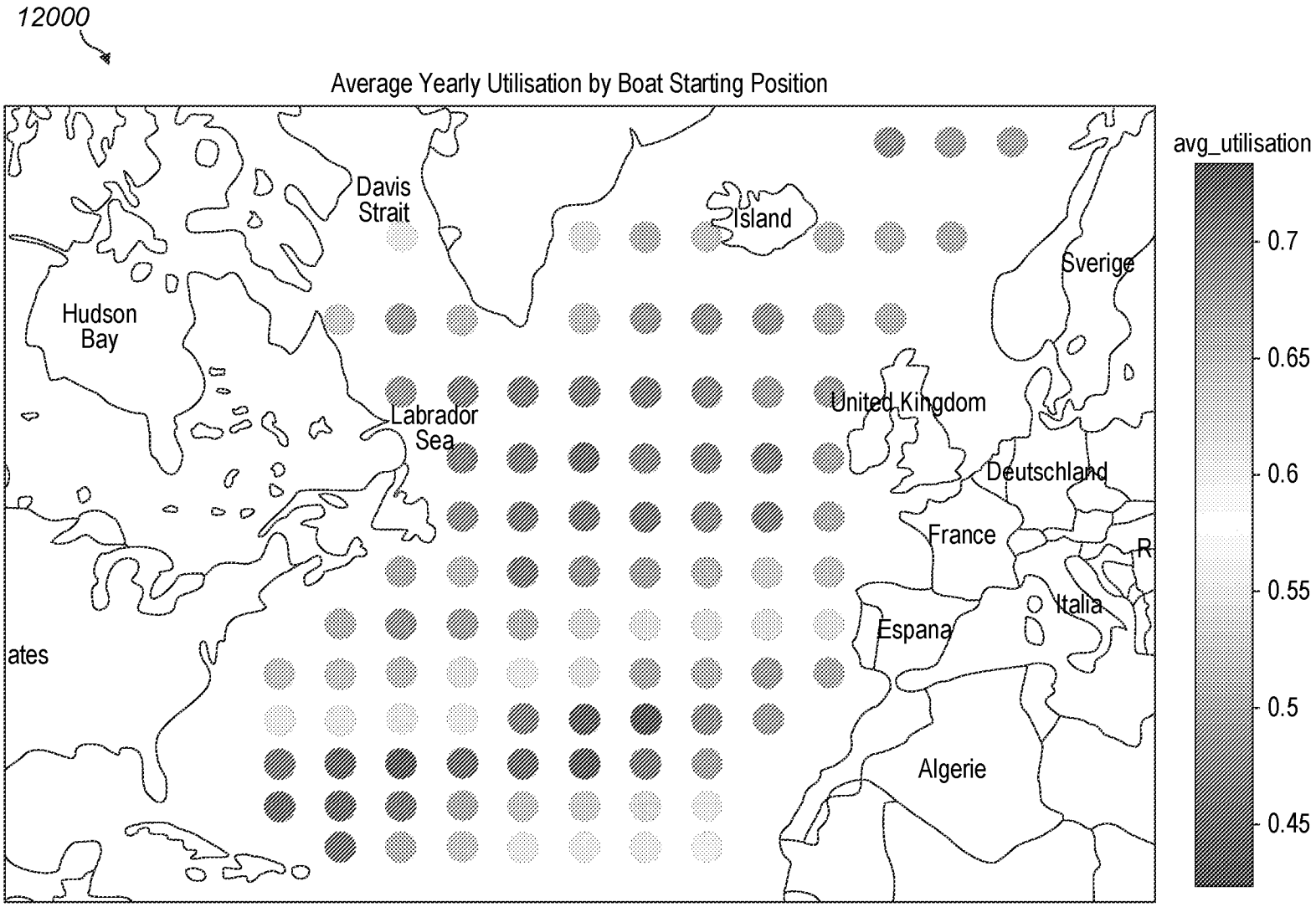

FIG. 20 shows a North Atlantic Ocean polygon 10000, a region for the routing of the vessel. In an example assessing the impact of starting location of the journey on the average annual utilisation, when observing the North Atlantic, it has been observed that an optimal greedy start location, close to the mid-North Atlantic, produces the highest utilisation (~82%) whereas starting locations closer to Europe result in average annual utilisations of 72-77%. These results are shown in graph 11000 of FIG. 21. This variation is consistent with the heat map for 100 points 12000, FIG. 22, generated using the greedy algorithm but the utilisations are higher due to the smart algorithm (and the heat map is based on 52 journeys rather than a single vessel sailing in a year).

Figure 23:
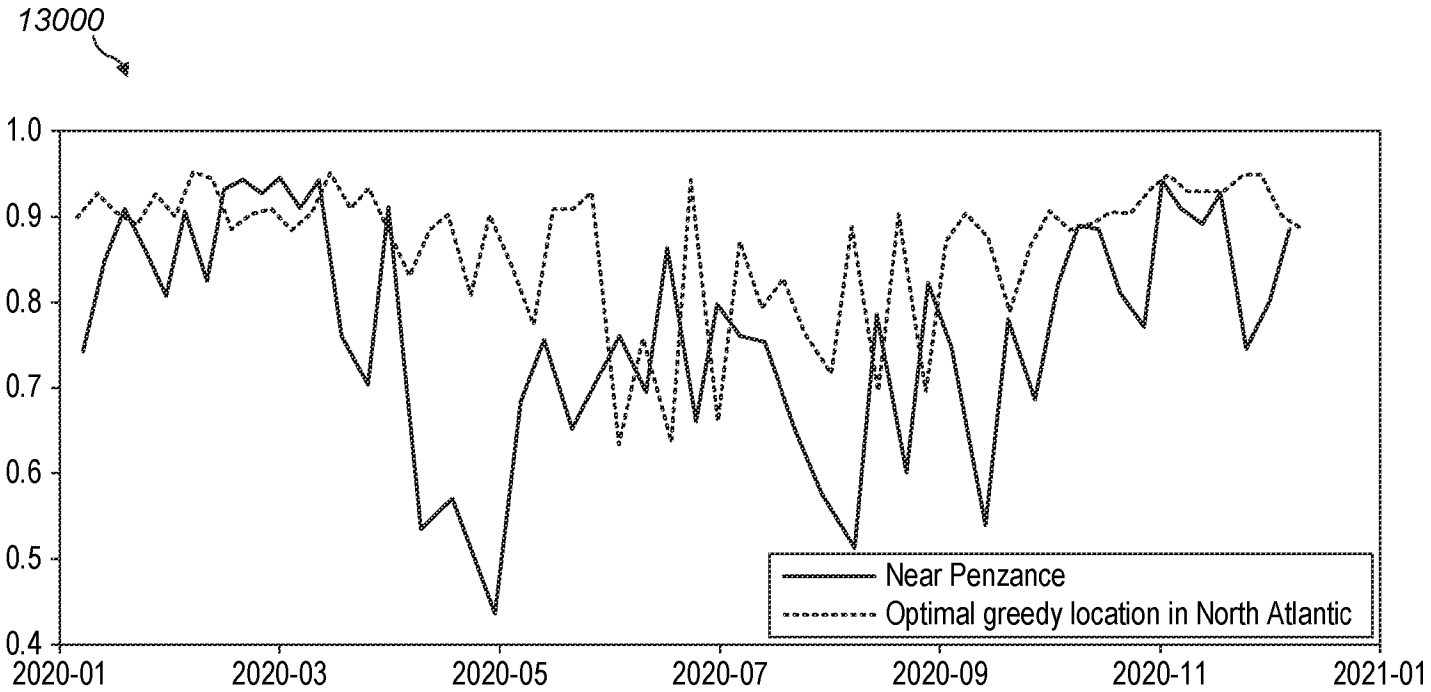

FIG. 23 shows a graph 13000 of utilisation across each individual journey for a vessel operating out of Penzance and a vessel operating from the optimal location found by the greedy algorithm. A noticeable difference between the two locations is that the utilisation starting in Penzance was much lower during spring, and that the lower utilisation season seems to be longer than it is in the North Atlantic.

Figure 24:
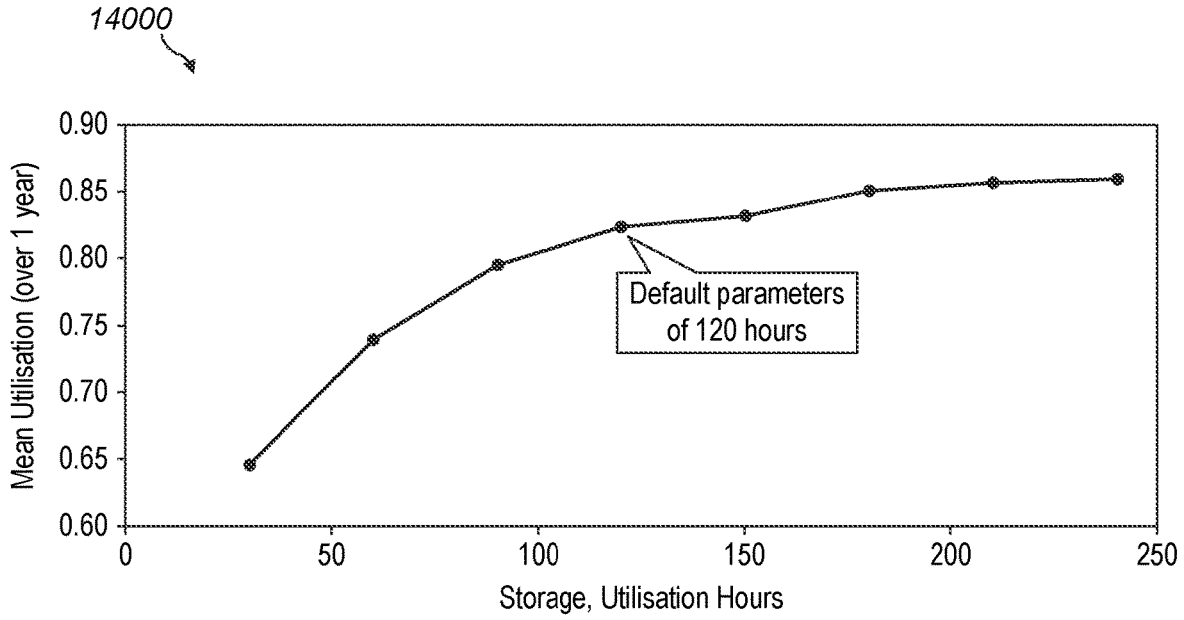

In an example that assesses the impact of modifying storage hours, i.e., energy storage volume of the vessel, on average annual utilisation, it has been observed that as the maximum storage capacity of the energy generation decreases, the average utilisation of the vessel decreases. The default parameter used in all the examples is 120 storage hours (5 days at 100% utilisation). When this value is reduced, the mean annual utilisation decreases. This may be due to having longer offloading times relative to journey durations, and there being less opportunity for the vessel to find areas of high wind. 120 hours of storage means the vessel will do at least 8760/126=70 journeys vs 30 hours storage=8760/36=243 journeys. As the utilisation hours increase, the mean utilisation increases but tails off to around 86% beyond 200 hours. The offloading time has an increasingly smaller impact on the utilisation. These results are shown in graph 14000, FIG. 24.

Figure 25:
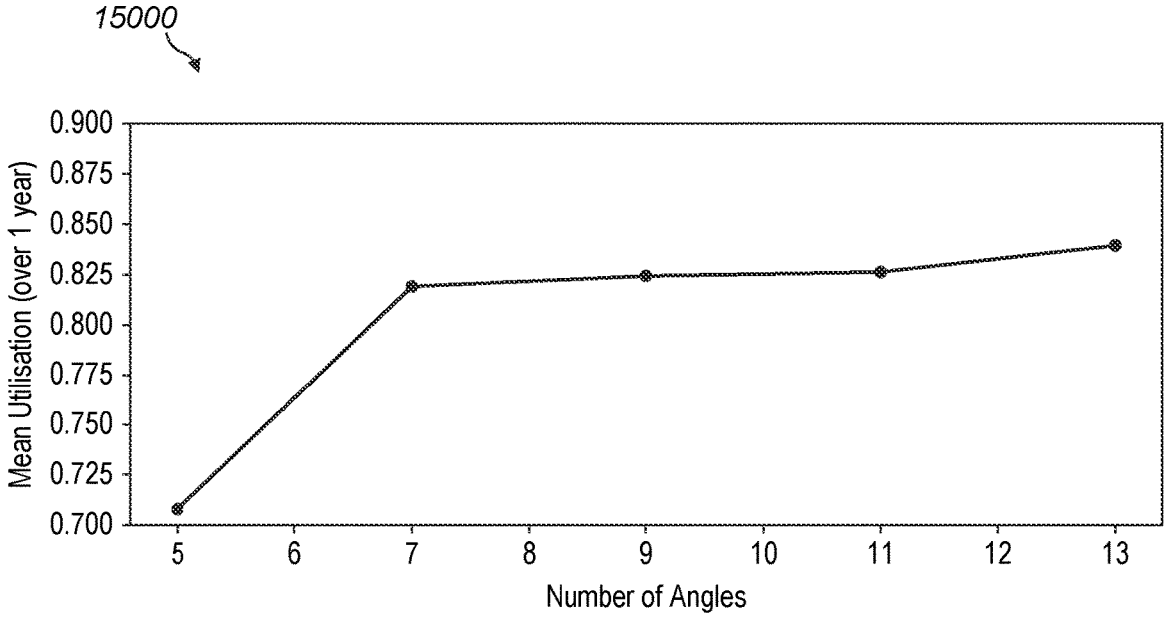

Increasing the number of discrete sailing angles of the vessel should in theory improve the utilisation as you are creating more options for the vessel to choose from to enable it to follow an optimal path. In an example that assesses the impact of modifying the number of discrete sailing angles on average annual utilisation, it has been observed that the increase above 10 sailing angles evenly spaced between 50 degrees and 310 degrees can improve the utilisation by 1-2% but there will be a trade-off with runtime increasing as the number of angles increase. It is likely that a manually curated list of angles that provide optimal sailing directions would give greater gains in utilisation. These results are shown in graph 15000, FIG. 25.

Figure 26:
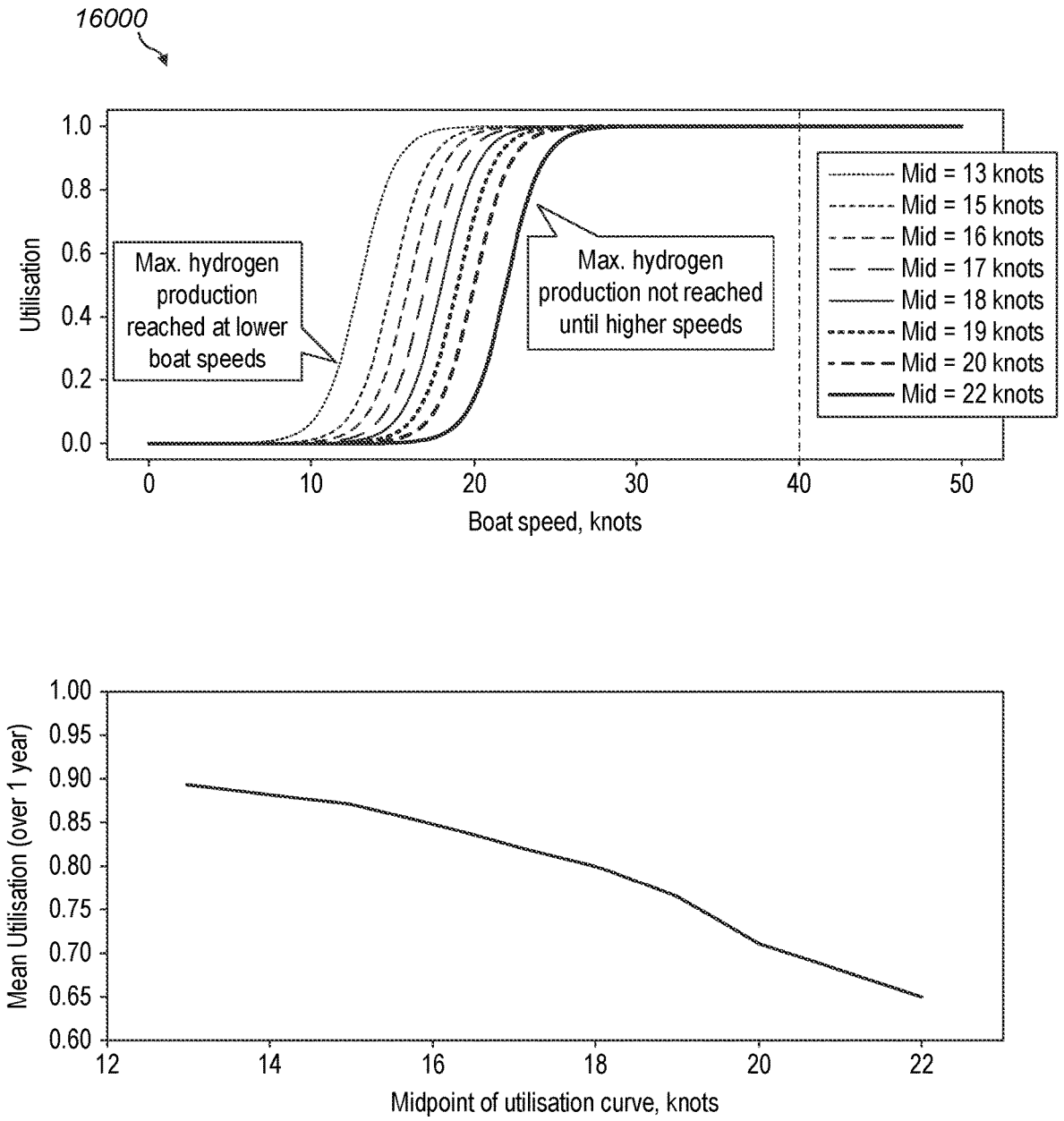

In an example that assesses the impact of modifying the utilisation s-curve on average annual utilisation, it has been observed that the choice of s-curve (i.e., the ability of the turbines of the vessel to produce reasonable volumes of hydrogen at lower speeds) has a significant impact on the annual utilisation. Ramp-ups at low speeds can increase the utilisation by ~5%. The default curve used in all examples uses a mid-point of 17 knots. These results are shown in graphs 16000, FIG. 26.

Figure 27:
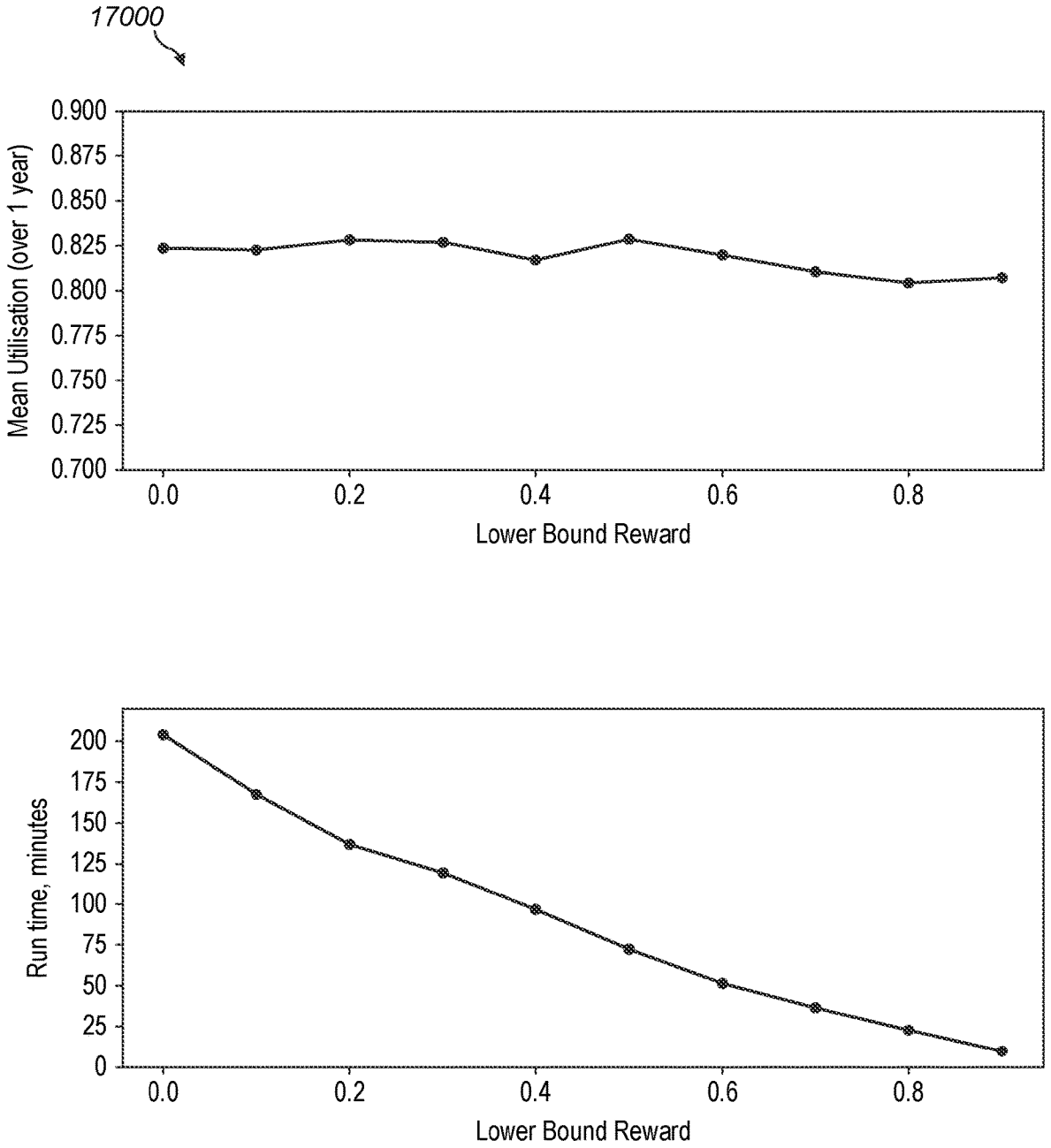

The impact of changing the lower bound on the mean utilisation and run time of the smart algorithm has been explored. The default parameter for the lower bound reward score was 0, i.e., routes are assessed with the assumption that the minimum utilisation in a time step is 0. This is quite conservative—increasing the lower bound will reduce the solution space and reduce the run time but there is a risk that the global optimal solution will be eliminated from the solution space. In an example that assesses the impact of changing the lower bound on mean utilisation and run-time of the smart algorithm on average annual utilisation, it has been observed that increasing the lower bound will reduce the solution space and reduce the run time but there is a risk that the global optimal solution will be eliminated from the solution space. Results show that you can reduce the run time significantly by increasing the lower bound reward without it having a significant impact on the mean utilisation. These results are shown in graphs 17000, FIG. 27.

Figure 28:
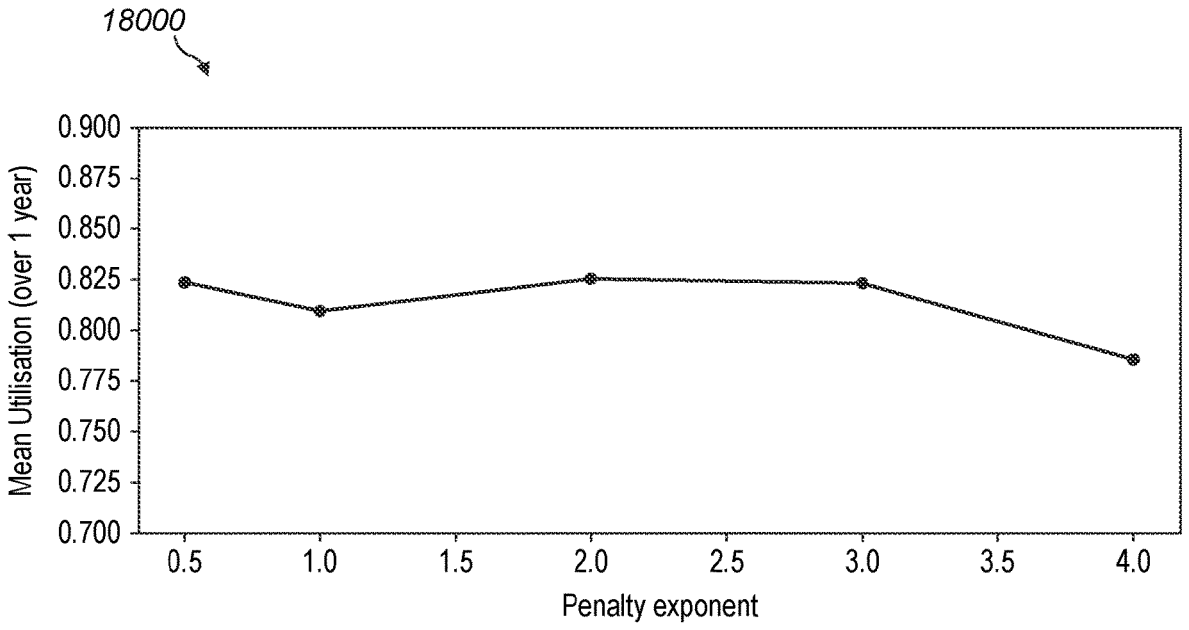

In an example that assesses the impact of increasing one of the parameters of the penalty function that is used to 'encourage' the vessel to return to its starting point when it is nearly full, it has been observed that for an exponent parameter (exponent_param) of 0.5 in a penalty function scale_param*(tank_fillˆexponent_param), increasing the exponent_param to high values (>1) results in a penalty function that encourages the vessel to explore for longer until the tank gets full whereas low values discourage the vessel to explore even when the tank is relatively empty. Increasing the exponent_param value results in the penalty function getting exponentially smaller for the same tank level. This effectively means that the vessel can travel further before it is encouraged back to the port. The results suggest that greater 'free range' does not necessarily result in a noticeable improvement in the mean utilisation. These results are shown in graph 18000, FIG. 28.

Figure 29:
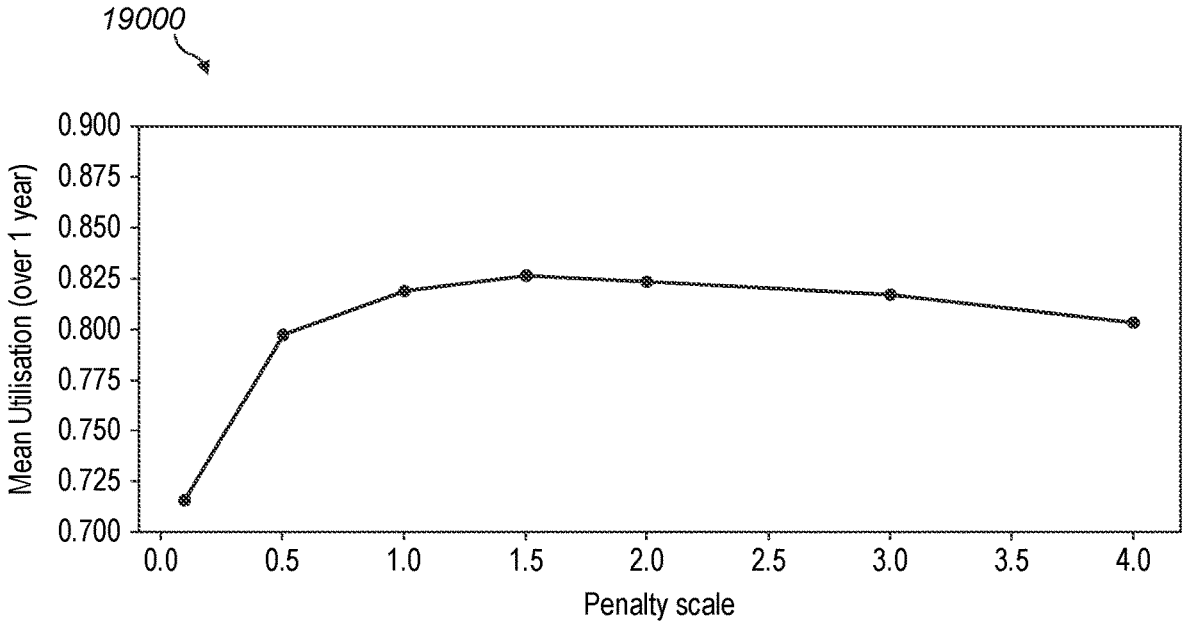

In an example that assesses the impact of changing the other parameters of the penalty function that is used to 'encourage' the vessel to return to its starting point when it is nearly full, it has been observed that for a scale parameter (scale_param) of 2 in a penalty function=scale_param*(tank_fillˆexponent_param), increasing the scale_param increases the amplitude of the 'return to port' signal. Results suggest that weaker signals (low values) result in a lower mean utilisation (e.g., the vessel reaches ~100% tank capacity well before returning to port). Very strong signals (above 2) also appear to result in a lower utilisation—perhaps as a result of the vessel being overly constrained to stay near port. The analysis suggests that this function can be tweaked to marginally improve the utilisation outcome (albeit avoiding low values for the penalty scale). These results are shown in graph 19000, FIG. 29.

Figure 30:
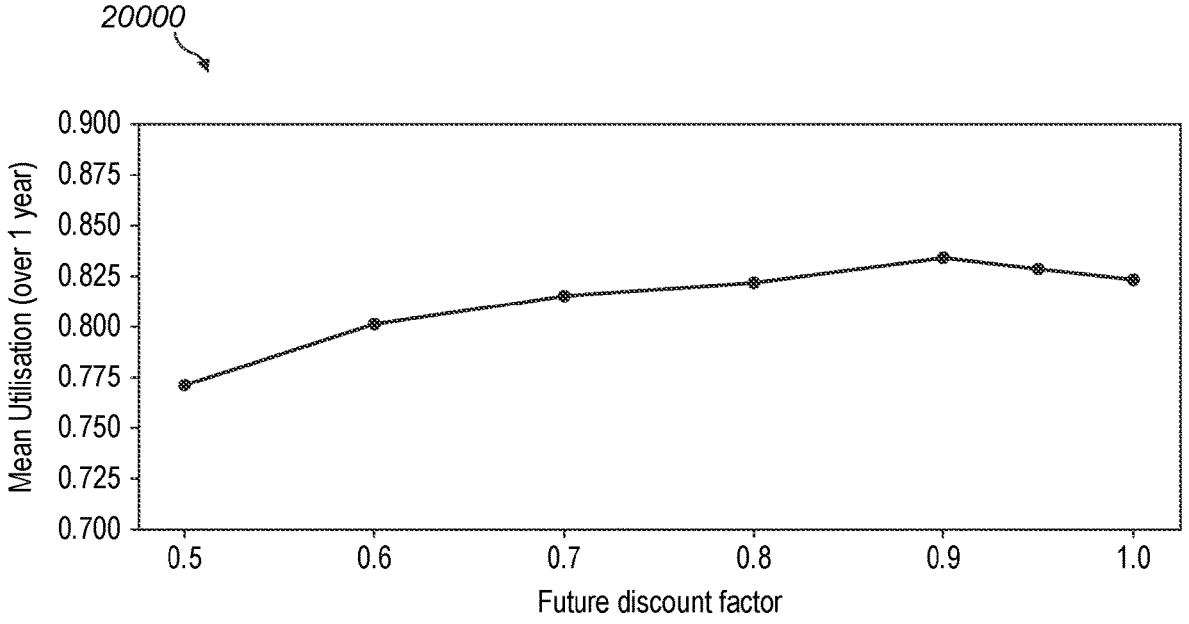

In an example that assesses the impact of varying the discount factor on the average annual utilisation, it has been observed that for a total net score=Sum over N horizons (net*discount_factorn), a large discount factor (e.g., 0.5) has a negative impact on the mean utilisation i.e., the algorithm is putting greater weight on the first time-steps and discounting routes that have better conditions at later timesteps. The use of a discount is a useful way of taking account of uncertainty in wind forecasts. The accuracy of forecasts will likely decrease with longer time horizons and therefore it is sensible to discount any forecast good wind conditions in the future to account for the uncertainty that they can be realised by the vessel. These results are shown in graph 20000, FIG. 30**.

Other Data

Figure 31:
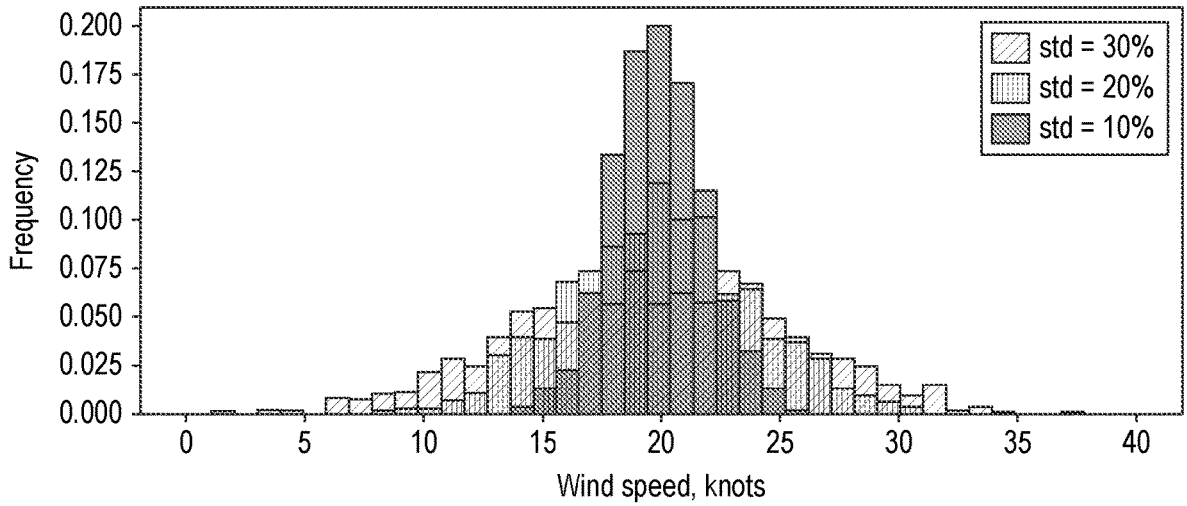
Figure 31:
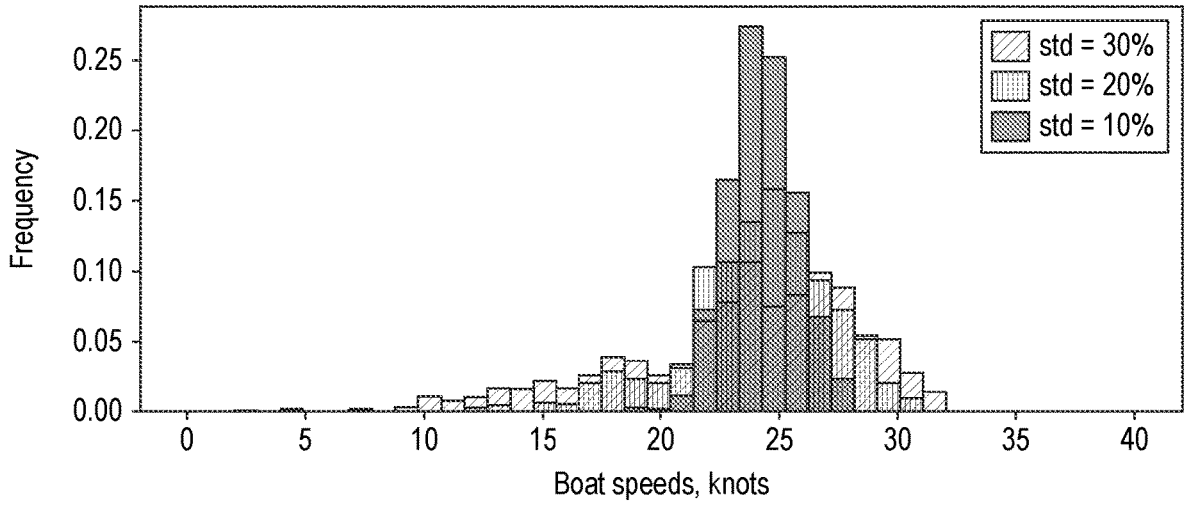

In specific examples, it is assumed that the wind speed is constant for a 3-hour time period, however, it is likely that this is an oversimplification. If it is assumed that the distribution of wind speeds can be approximated as a normal distribution, alternative utilisations can be assessed. These results are shown in graphs 21000, FIG. 31.

Figure 32:
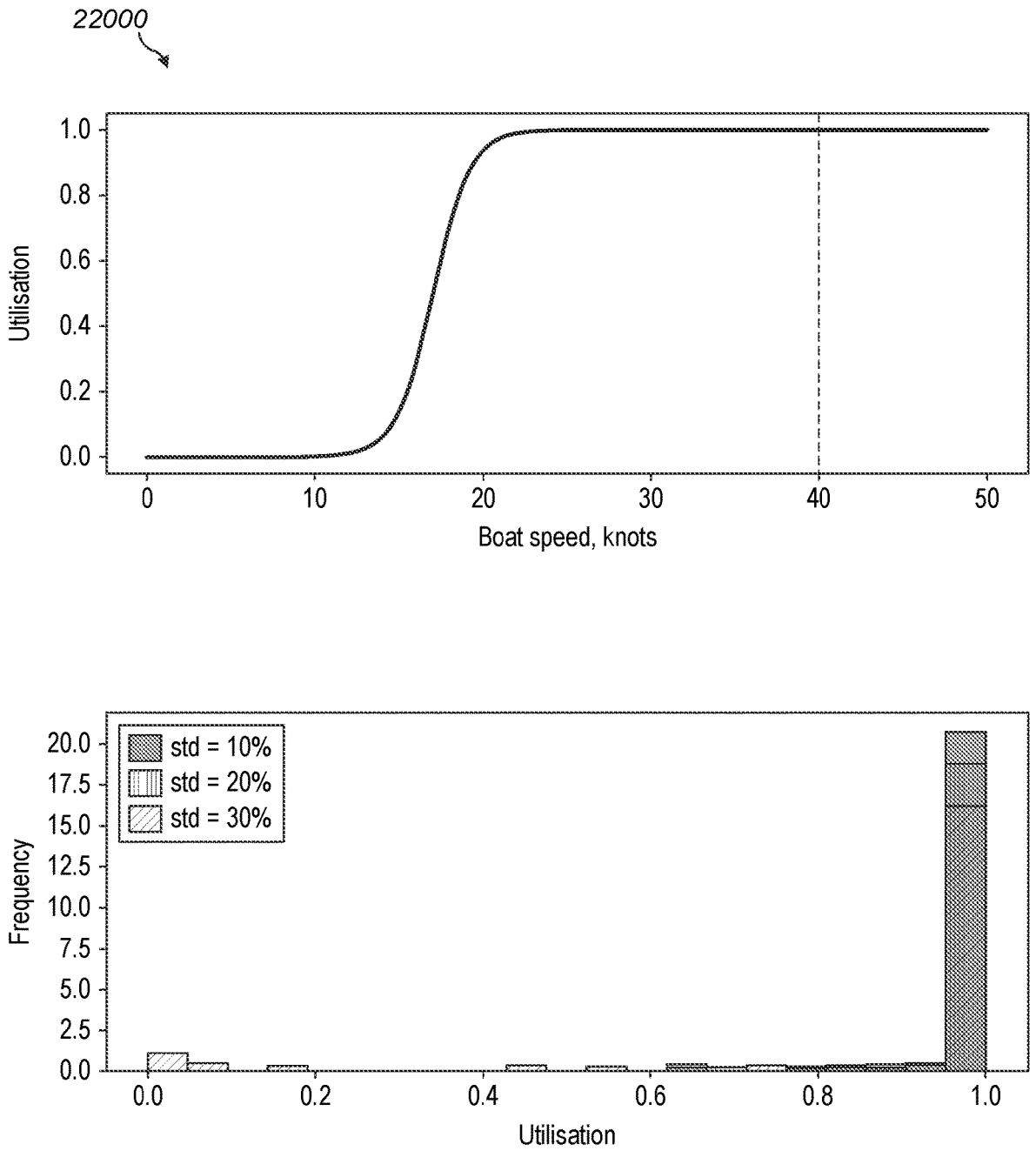
Figure 33:
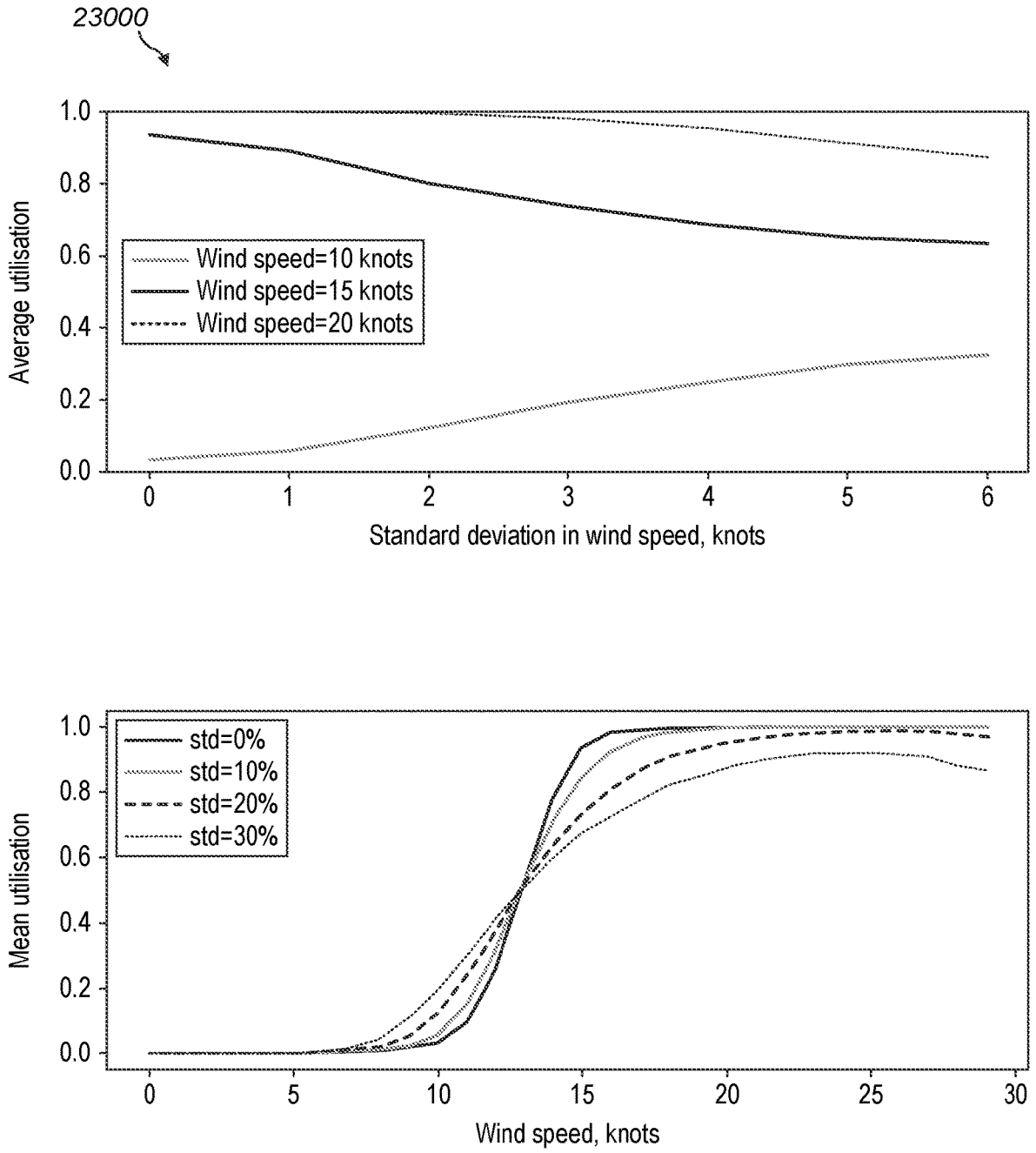

Utilisations are possible for various vessel speeds. While the distribution of utilisations is still has a mode at 1, some of the wind speeds in this distribution can have utilisations as low as 0. Using the current assumptions, a vessel in 20 knot wind sailing at 110 degrees would have a utilisation of ~1. These results are shown in graphs 22000, FIG. 32. However, the utilisation will vary depending on the size of the variation in wind speed (left graph, graphs 23000, FIG. 33). For a given sailing angle, new utilisation curves for different distributions of wind may be plotted (right graph, graphs 23000, FIG. 33). If there is significant variation in the wind then utilisations of 1 in a given time period are unlikely to be obtained.

Embodiments

1. A movable maritime vessel for generating, storing and transporting energy, the vessel comprising:
   a hull;
   at least one sail configured to capture wind energy to move the vessel; and
   an energy generation system comprising a hydro generator, wherein the hydro generator is configured to generate energy from the movement of fluid, for example sea water, through the hydro generator.
2. The vessel of embodiment 1, further comprising an energy transformation system configured to receive and process energy generated by the energy generation system.
3. The vessel of embodiment 1 or embodiment 2, further comprising an energy storage system configured to store energy received from the energy generation system and/or the energy transformation system.
4. The vessel of embodiment 2 or embodiment 3, wherein the energy transformation system comprises:
   i) a water purification plant for purifying liquid, for example sea water, wherein the water purification plant comprises at least one of a filter and a desalination unit, the water purification plant being configured to output purified liquid via a first conduit; and
   ii) an electrolysis plant for electrolysing liquid received from the water purification plant via the first conduit, and for outputting gas e.g. oxygen gas to atmosphere via a second conduit, and for outputting gas e.g. hydrogen gas via a third conduit.
5. The vessel of embodiment 4, further comprising a liquefaction plant for liquefying gas e.g. hydrogen gas received from the electrolysis plant via the third conduit and outputting liquid e.g. liquid hydrogen via a fourth conduit.
6. The vessel of embodiment 4 or embodiment 5, wherein one of, any number of, or all of the water purification plant, electrolysis plant and liquefaction plant is partially or entirely powered by energy from the energy generation system.
7. The vessel of embodiment 5 or embodiment 6, wherein the energy storage system comprises a cryogenic storage tank for storing liquid, for example liquid hydrogen, received from the liquefaction plant via the fourth conduit.
8. The vessel of any one of embodiments 4 to 7, wherein the energy storage system comprises a compressor configured to receive gas, for example hydrogen gas, from the electrolysis plant via the third conduit and a gas storage tank for storing the gas.
9. The vessel of any one of embodiments 4 to 8, wherein the energy storage system further comprises a fuel cell, for example a hydrogen fuel cell, wherein the storage tank is configured to output hydrogen gas boil off via a fifth conduit and wherein the fuel cell is configured to receive hydrogen gas boil off from the cryogenic storage tank via the fifth conduit.
10. The vessel of any one of the preceding embodiments, wherein the hydro generator is:
    i) directly attached to the hull; or
    ii) attached to the hull by a flexible or inflexible connector so that the vessel tugs the hydro generator.
11. The vessel of any one of the preceding embodiments, wherein the energy generation system further comprises at least one solar panel or an array of solar panels.
12. The vessel of embodiment 11, wherein the at least one solar panel or array of solar panels is located on at least one upward facing surface of the hull and/or embedded in the at least one sail.
13. The vessel of any one of embodiments 3 to 12, wherein the energy storage system comprises a battery or an array of batteries configured to store energy from any part of the energy generation system and/or the energy transformation system.
14. The vessel of any one of the preceding embodiments, further comprising circuitry configured to communicate with a remote control system in order to navigate the vessel, for example autonomously and/or with the use of artificial intelligence.
15. The vessel of embodiment 14, wherein the circuitry is partially or entirely powered by energy from the energy generation system.
16. A method comprising the steps of:
    generating energy on a movable maritime vessel via an energy generation system;

transforming the energy generated by the energy generation system on the vessel via an energy transformation system;

storing the energy received from the energy generation system and/or the energy transformation system on the vessel by means of an energy storage system; and transporting the energy stored in the energy storage system to an endpoint on land.

17. The method of embodiment 16, wherein the vessel is a vessel according to any one of embodiments 1 to 15.

18. A control system for remotely routing a vessel according to any one of embodiments 1 to 15 and/or for executing a method according to embodiment 16 or embodiment 17, for example autonomously, for example by artificial intelligence.

19. A computer-implemented method for routing a movable maritime vessel to optimise energy generation along a journey, the movable maritime vessel capable of generating, storing and transporting energy, the method comprising:

a) receiving one or more inputs associated with the journey;

b) based on the received inputs, determining a set of possible routes for the vessel to be optimised over N timesteps of the journey, where N is a predetermined number;

c) from the set of possible routes, identifying an optimal route to be taken by the vessel over a next timestep of the journey;

d) navigating the vessel over the next timestep of the journey according to the identified optimal route; and e) after navigating the vessel over the next timestep of the journey, determining whether the vessel has completed the journey.

20. The method of embodiment 19, wherein step b) comprises:

b1) based on the received inputs, determining a set of possible routes for the vessel over a next timestep;

b2) assigning each of the possible routes for the vessel over the next timestep a net score, wherein the net score is a reward score for the respective route less a penalty score for the respective route;

b3) filtering out possible routes for the vessel over the next timestep having a net score below a predetermined threshold; and b4) incrementing the timestep and repeating steps b1) through b3) N−1 times for each of the routes not filtered out to determine a set of possible routes for the vessel to be optimised over N timesteps of the journey.

21. The method of embodiment 19, wherein step b) comprises:

b1) based on the received inputs, determining a set of possible routes for the vessel over a next timestep;

b2) for each of the possible routes for the vessel over the next timestep, calculating an expected position of the vessel at the end of the timestep, a reward score for the respective route and a penalty score for the respective route;

b3) assigning each of the possible routes for the vessel over the next timestep a net score based on the reward score for the respective route and the penalty score for the respective route;

b4) selecting one or more of the possible routes for the vessel over the next timestep based on their respective net scores; and b5) incrementing the timestep, and repeating steps b1) through b4) N−1 times for each of the one or more selected possible routes for the vessel over the next timestep to determine a set of possible routes for the vessel to be optimised over N timesteps, wherein each of the set of possible routes for the vessel to be optimised over N timesteps is assigned an aggregate net score based on the sum of the net scores of each of its respective timestep routes.

22. The method of any one of embodiments 20 or 21, wherein the one or more inputs comprise real-time and/or forecasted wind speed and wind direction data and step b1) comprises:

b1.1) based on the wind direction data, determining a set of possible sailing angles of the vessel;

b1.2) based on the wind speed data, calculating possible vessel speeds for each route of the set of possible routes for the vessel over the next timestep, wherein each route for the vessel over the next timestep corresponds to one of the set of possible sailing angles of the vessel;

b1.3) based on the vessel speeds, estimating a vessel location for each route of the set of possible routes for the vessel at the end of the next timestep;

b1.4) based on the received inputs, filtering out those routes which result in the vessel location at the end of the next timestep being outside a region of interest, for example, where the wind speed at the location of the vessel at the end of the next timestep exceeds a maximum tolerable wind speed that the vessel can sail into.

23. The method of any one of embodiments 19 to 22, wherein step b) comprises assigning an aggregate net score to each route of the set of possible routes, wherein the aggregate net score for each route is a sum of reward scores for each timestep of the respective route less a sum of penalty scores for each timestep of the respective route.

24. The method of any one of embodiments 19 to 23, wherein step b) comprises estimating a best-case aggregate net score and a worst-case aggregate net score for each route of the set of possible routes for the vessel to be optimised over N timesteps of the journey, wherein the aggregate net score for each route is a sum of reward scores for each timestep of the respective route less a sum of penalty scores for each timestep of the respective route, and filtering out those routes for which the best-case aggregate net score is worse than the route with the highest worst-case aggregate net score.

25. The method of embodiment 24, wherein estimating the best-case aggregate net score and the worst-case aggregate net score for each route of the set of possible routes for the vessel to be optimised over N timesteps of the journey is based on a branch and bound algorithm.

26. The method of any one of embodiments 20 to 25, wherein the calculations of the penalty score for each timestep of a respective route and the reward score for each timestep of a respective route comprise a determination based on the one or more received inputs, for example, environmental data, for example, data relating to oceanic routes.

27. The method of any one of embodiments 20 to 26, wherein the vessel comprises an energy storage medium, and wherein the calculation of the penalty score for each timestep of a respective route comprises a determination based on how far the vessel will be from a predetermined end location of the journey at the end of the timestep, and wherein the strength of the penalty score increases as an amount of energy stored by energy storage medium of the vessel increases.

28. The method of any one of embodiments 20 to 27, wherein the vessel comprises an energy generation system, and wherein the reward score for each timestep of a respective route comprises a determination based on a sigmoid curve that relates vessel speed to a utilisation of an energy generation system of the vessel.

29. The method of any one of embodiments 20 to 28, wherein the reward score for each timestep of a respective route is scaled inversely proportional to an amount of time in the future the timestep is.

30. The method of any one of embodiments 21 or 23 to 25, wherein step c) comprises selecting a route from the set of possible routes for the vessel to be optimised over N timesteps that has the highest aggregate net score.

31. The method of any one of embodiments 19 to 30, wherein the vessel comprises an energy storage medium and/or an energy generation system, for example, a hydro generator.

32. The method of any one of embodiments 19 to 31, wherein the one or more inputs associated with a journey of the vessel comprises real-time and/or forecasted weather data, for example, wind data and/or wherein the one or more inputs associated with a journey of the vessel comprises one or more of journey properties, vessel properties, environmental data and weather data, and/or wherein the journey properties comprise one or more of journey starting location, journey ending location and journey starting time.

33. The method of embodiment 32, wherein the vessel properties comprise one or more of a number of discrete sailing angles, a number of timesteps over which to optimise route determination, N, a maximum tolerable wind speed that the vessel can sail into by the vessel, performance data of the vessel, for example, how well the vessel operates in particular wind and/or wave states, and an amount of energy capable of being stored by the vessel.

34. The method of any one of embodiments 32 or 33, wherein the environmental data comprises one or more of data relating to spot prices of liquid hydrogen at various locations, hazard data for oceanic routes, data relating to oceanic shipping channels, environmental data, for examples, satellite data relating to ice flows, data relating to oceanic piracy activity, data relating to marine life, for example oceanic whale routes, data relating to obstacles in the ocean, for example, icebergs or fallen shipping containers, automatic identification system (AIS) data, for example, data relating to other vessels in the ocean.

35. The method of any one of embodiments 32 to 34, wherein the weather data comprises one or more of real-time and/or forecasted wind speed, real-time and/or forecasted wind direction, and/or real-time and/or forecasted oceanic data, for example, wave data, for one or more regions of interest.

36. The method of any one of embodiments 19 to 35, wherein if it is determined that the vessel has not completed the journey, the method further comprises repeating steps a) through e).

37. The method of any one of embodiments 19 to 36, wherein step d) comprises transmitting instructions to the vessel to perform the identified optimal route over the next timestep.

38. The method any one of embodiments 19 to 37, wherein step e) comprises:

e1) determining whether the vessel is within a predetermined radius, for example, a nautical mile radius, for example, a nautical 30-mile radius, 25-mile radius, 20-mile radius, 15-mile radius, 10-mile radius, 5-mile radius, 4-mile radius, 3-mile radius, 2-mile radius or 1-mile radius, of a predetermined end location of the journey;

e2) determining whether an amount of energy stored by an energy storage medium of the vessel is above a predetermined percentage of an energy storage capacity of the energy storage medium; and e3) if both e1) and e2) are determined positively, determining that the vessel has completed the journey, and if one or both of e1) and e2) are determined negatively, determining that the vessel has not completed the journey.

39. The method of any one of embodiments 19 to 38, wherein the journey comprises a journey of the vessel from a predetermined start location to one of a set of predetermined end locations.

40. The method of any one of embodiments 19 to 39, wherein step a) comprises receiving an updated end location of the journey during the journey.

41. The method of any one of embodiments 19 to 40, wherein the energy generation comprises hydro energy generation of the vessel and/or wherein the energy generation comprises wind energy generation of the vessel, and/or wherein the energy generation comprises solar energy generation of the vessel, optionally wherein optimising energy generation comprises maximising hydrogen generation of the vessel for each timestep of the journey and/or wherein a timestep defines a period of time which may be varied in length across the journey.

42. The method of any one of embodiments 19 to 41, wherein a timestep defines a predetermined period of time, for example, approximately, exactly or less than 10 hours, approximately, exactly or less than 9 hours, approximately, exactly or less than 8 hours, approximately, exactly or less than 7 hours, approximately, exactly or less than 6 hours, approximately, exactly or less than 5 hours, approximately, exactly or less than 4 hours, approximately, exactly or less than 3 hours, approximately, exactly or less than 2 hours, or approximately, exactly or less than 1 hour, optionally wherein a timestep defines a period of time which may be varied in length across the journey.

43. The method of any one of embodiments 19 to 42, wherein the predetermined number, N, defines the number of time horizons over which to optimise the determination of a set of possible routes for the vessel.

44. A computer readable medium comprising instructions for causing a processor to execute instructions according to the method of any one of embodiments 19 to 43.

45. A computer program comprising instructions which, when the program is executed by a computer, cause the computer to carry out the steps of any one of embodiments 19 to 43.

46. A trained model for executing step c) according to any one of embodiments 19 to 43, wherein step c) is performed by machine learning.

47. A control system for routing, for example, remotely, a vessel, the control system comprising one or more processors configured to perform the method of any one of embodiments 19 to 43, for example autonomously, for example by artificial intelligence.

48. A movable maritime vessel for generating, storing and transporting energy, the vessel comprising:
a hull;
at least one sail configured to capture wind energy to move the vessel;
an energy generation system comprising a hydro generator, wherein the hydro generator is configured to generate energy from the movement of fluid, for example sea water, through the hydro generator; and
a processor configured to communicate with the control system of embodiment 47 for routing the vessel.

The invention claimed is:

1. A movable maritime vessel comprising:
a hull;
at least one sail configured to capture wind energy to move the vessel;
an energy generation system comprising a hydro generator, wherein the hydro generator is configured to generate energy from a movement of a fluid through the hydro generator;
an energy storage system configured to store the generated energy received from the energy generation system; and
a processor configured to communicate with a remote control system to navigate the vessel and transport the generated energy stored in the energy storage system to an endpoint for transporting to at least one of a port and a hub for subsequent energy discharge.

2. The vessel of claim 1, wherein the hydro generator is:
i) directly attached to the hull; or
ii) attached to the hull by a flexible or inflexible connector so that vessel tugs the hydro generator.

3. The vessel of claim 1, wherein the energy generation system further comprises at least one solar panel or an array of solar panels.

4. The vessel of claim 3, wherein the at least one solar panel or the array of solar panels is located on at least one upward facing surface of the hull and/or embedded in the at least one sail.

5. The vessel of claim 1, further comprising circuitry configured to communicate with a remote control system in order to navigate the vessel autonomously or using artificial intelligence.

6. The vessel of claim 5, wherein the circuitry is partially or entirely powered by energy from the energy generation system.

7. The vessel of claim 1, further comprising an energy transformation system configured to receive and process energy generated by the energy generation system.

8. The vessel of claim 7, wherein the energy storage system is further configured to store energy received from the energy transformation system.

9. The vessel of claim 7, wherein the energy storage system further comprises a battery or an array of batteries configured to store the energy from any part of the energy generation system or the energy transformation system.

10. The vessel of claim 7, wherein the energy transformation system comprises:
i) a water purification plant for purifying liquid, wherein the water purification plant comprises at least one of a filter and a desalination unit, the water purification plant being configured to output purified liquid via a first conduit; and
ii) an electrolysis plant for electrolyzing the liquid received from the water purification plant via the first conduit, and for outputting a first gas to atmosphere via a second conduit, and for outputting a second gas via a third conduit.

11. The vessel of claim 10, wherein the energy storage system further comprises a compressor configured to receive gas from the electrolysis plant via the third conduit and a gas storage tank for storing the gas.

12. The vessel of claim 10, further comprising a liquefaction plant for liquefying gas received from the electrolysis plant via the third conduit and outputting the liquid via a fourth conduit.

13. The vessel of claim 12, wherein one of, any number of, or all of the water purification plant, the electrolysis plant and the liquefaction plant is partially or entirely powered by energy from the energy generation system.

14. The vessel of claim 12, wherein the energy storage system further comprises a cryogenic storage tank for storing the liquid received from the liquefaction plant via the fourth conduit.

15. The vessel of claim 14, wherein the energy storage system further comprises a fuel cell, wherein the cryogenic storage tank is configured to output hydrogen gas boil off via a fifth conduit, and wherein the fuel cell is configured to receive hydrogen gas boil off from the cryogenic storage tank via the fifth conduit.

16. A method comprising:
generating energy on a movable maritime vessel via an energy generation system;
transforming the energy generated by the energy generation system on the vessel via an energy transformation system;
storing, using an energy storage system, the energy received from the energy generation system or the energy transformation system on the vessel; and
transporting the energy stored in the energy storage system to an endpoint on land by using a processor to communicate with a remote control system to navigate the vessel and transport the generated energy stored in the energy storage system to an endpoint for transporting to at least one of a port and a hub for subsequent energy discharge.

17. The method of claim 16, wherein the movable maritime vessel comprises:
a hull;
at least one sail configured to capture wind energy to move the vessel; and
the energy generation system comprising a hydro generator, wherein the hydro generator performs the generating of the energy from a movement of a fluid through the hydro generator.

18. The method of claim 17, further comprising:
remotely routing, using a control system, the movable maritime vessel autonomously.

19. The method of claim 18, wherein the routing occurs using artificial intelligence.

* * * * *